US009889702B2

(12) United States Patent
Li et al.

(10) Patent No.: US 9,889,702 B2
(45) Date of Patent: Feb. 13, 2018

(54) WRITING TOOL FOR MOUNTING ON A FINGER AND WRITING TOOL FINGER HOLDER

(71) Applicant: GOUDOUGAISYA TOYAKOHATSUMEI, Tokyo (JP)

(72) Inventors: Tetsuei Li, Tokyo (JP); Seigen Li, Tokyo (JP)

(73) Assignee: GOUDOUGAISYA TOYAKOHATSUMEI, Tokyo (JP)

( * ) Notice: Subject to any disclaimer, the term of this patent is extended or adjusted under 35 U.S.C. 154(b) by 0 days.

(21) Appl. No.: 15/035,685

(22) PCT Filed: Dec. 14, 2015

(86) PCT No.: PCT/JP2015/084935

§ 371 (c)(1),
(2) Date: May 10, 2016

(87) PCT Pub. No.: WO2016/104221

PCT Pub. Date: Jun. 30, 2016

(65) Prior Publication Data

US 2016/0339736 A1 Nov. 24, 2016

(30) Foreign Application Priority Data

Dec. 22, 2014 (JP) ..... 2014-258240

(51) Int. Cl.
*A46B 5/02* (2006.01)
*B43K 23/012* (2006.01)
(Continued)

(52) U.S. Cl.
CPC ..... *B43K 23/012* (2013.01); *B43K 23/004* (2013.01); *B43K 23/008* (2013.01);
(Continued)

(58) Field of Classification Search
CPC .. B43K 23/004; B43K 23/008; B43K 23/012; B43K 29/087
(Continued)

(56) References Cited

U.S. PATENT DOCUMENTS 4,149,812 A * 4/1979 Huffman, Jr. ..... B43K 23/122 401/195
7,371,026 B2 * 5/2008 Berger ..... G09B 11/02 401/8
(Continued)

FOREIGN PATENT DOCUMENTS

CN 101166634 A 4/2008
EP 1 894 742 A1 3/2008
(Continued)

OTHER PUBLICATIONS

Office Action issued by the Chinese Patent Office dated Feb. 4, 2017 in corresponding Chinese Patent Appln No. 201580002836.8 and corresponds to U.S. Appl. No. 15/035,685; 7pp.
(Continued)

*Primary Examiner* — Jennifer C Chiang
(74) *Attorney, Agent, or Firm* — Studebaker & Brackett PC

(57) ABSTRACT

The part for mounting on the finger is provided so as to be integral with a linking member; by means of building-in, folding, inserting and removing, and winding, the holder is made deformable to a carried condition when not in use; a necessary shortest dimension of the writing tool in the written condition is divided into at least two sections, i.e., an axis body 1 and a cap 2; and then, the axis body 1 and the cap 2 are overlapped with each other by means of folding or storing to thereby shorten the writing tool in a retained condition, and the writing tool in the written condition is
(Continued)

reversibly movable in a predetermined range to thereby make an angle of the writing tool adjustable.

10 Claims, 17 Drawing Sheets

(51) Int. Cl.

| | |
|---|---|
| ***B43K 23/004*** | (2006.01) |
| ***B43K 23/008*** | (2006.01) |
| ***B43K 24/02*** | (2006.01) |
| ***B43K 24/16*** | (2006.01) |
| ***B43K 29/087*** | (2006.01) |
| ***B43K 29/10*** | (2006.01) |

(52) U.S. Cl.
CPC ..... *B43K 24/02* (2013.01); *B43K 24/16* (2013.01); *B43K 29/087* (2013.01); *B43K 29/10* (2013.01)

(58) Field of Classification Search
USPC ..... 401/6–8
See application file for complete search history.

(56) References Cited

U.S. PATENT DOCUMENTS

| | | | | |
|---|---|---|---|---|
| 8,840,157 | B2 * | 9/2014 | Dempsey ..... | A46B 5/025 294/25 |
| 2005/0069371 | A1 | 3/2005 | Lutgen et al. | |

FOREIGN PATENT DOCUMENTS

| | | | |
|---|---|---|---|
| FR | 2 741 245 | A1 | 5/1997 |
| JP | 2005-271570 | A | 10/2005 |
| JP | 4528350 | B1 | 8/2010 |
| WO | 2011/016179 | A1 | 2/2011 |

OTHER PUBLICATIONS

International Search Report and Written Opinion of PCT/JP2015/084935 dated Feb. 23, 2016.

The extended European search report issued by the European Patent Office dated Aug. 25, 2017, which corresponds a European Patent Application No. 15872790.9-1704 and is related to U.S. Appl. No. 15/035,685.

* cited by examiner

WRITING TOOL FOR MOUNTING ON A FINGER AND WRITING TOOL FINGER HOLDER

TECHNICAL FIELD

The present invention relates to a writing tool for mounting on a finger and a writing tool finger holder (Japanese Trademark, Trademark Application No. 2014-101424) for mounting a writing tool on an index finger to make a written condition and a retained condition interchangeably switchable, and in the retained condition, enable other operations while a writing tool is mounted on the finger. The writing tool according to the present invention includes a tool such as a touch pen or a laser pen used for operations of electromagnetic waves, light beams, electricity and static electricity to be carried out by orienting a tip of brush to an object as well as a writing tool for tracing handwriting on an object in order to write (draw) letters, pictures, drawings or the like.

BACKGROUND ART

Conventionally, when writing and other operations are alternately carried out, a movement of gripping and releasing a writing tool are repeatedly carried out every time and thus such repetition has been inefficient and cumbersome. In order to solve the problem described above, the present inventor invented and presented a writing tool finger holder and a writing tool which are used while alternately switching a written condition and a held condition with the writing tool being mounted on an index finger.

PRIOR ART DOCUMENT

Patent Document

[Patent Document 1] Japanese Patent No. 4528350

SUMMARY OF THE INVENTION

Problems to be Solved by the Invention

According to the abovementioned Japanese Patent No. 4528350 of the prior art (hereinafter, referred to as the prior art), a writing tool finger holder and a writing tool for mounting on a finger have achieved five functions that follow:

1. A function of forming a degree of inclination for the purpose of change of an angle necessary for condition switching and crossing a finger and a writing tool;
2. A function of advancing and retracting or expanding or contracting the writing tool by which a tip of brush is placed in front of a tip of an index finger in a written and at the back of the tip of the index finger in a retained condition;
3. An orientation function of retaining the writing tool at a predetermined angle and at a predetermined position;
4. A posture stabilization function to disallow a posture of the writing tool to collapse even if a thumb is released from the writing tool; and
5. An operation simplification function to enable condition switching with only the thumb (hereinafter, referred to as the "five functions") (refer to paragraph [0005] and claims 1 and 2 of the prior art).

However, upon carrying out the prior art described hereinabove, there has been three drawbacks described below.

First, a part for mounting on a finger becomes an obstacle for carrying and storage. In the prior art, although the part for mounting on the finger has been devised to have various shapes, the part for mounting on the finger is fixed to the finger as just an independent structure. Therefore, in the carried condition, the structure is attached to the writing tool as it is. Consequently, the part for mounting on the finger becomes an obstacle for transportation, carrying and storage. Particularly, this circumstance is still more significant in a case where the part for mounting on the finger, having a ring shape, is attached to the writing tool. Accordingly, the part for mounting on the finger requires a function of making the writing tool deformable in such a manner as not to become an obstacle for transportation, carrying and storage, as well as a function of attaching the part for mounting on the finger to the finger in a held state after the part for mounting on the finger has been released from the finger.

Second, the function of expanding or contracting and advancing or retracting the writing tool is insufficient. In the prior art, although an attempt has been made to solve this problem by employing the function of expanding or contracting and advancing or retracting the writing tool as one of the essential functions, a tip end of the writing tool in the held state has been merely retracted up to the back of the index fingertip. In the circumstance described above, even though the position of the tip of brush in the held state is kept unchanged from that in the written condition and does not protrude to the index finger, this is incomplete in terms of comfortably carrying out other operations while the writing tool is mounted on the fingers (refer to paragraph [0005] of the prior art).

For a general adult, the distance from the fingertip to a first joint of the index finger is about 2 to 3 cm and the distance from the first joint to the second joint is about 3 to 4 cm. Therefore, in a case where other operations such as gripping an object by bending a finger are carried out in the retained condition, it may be that the more significantly the writing tool protrudes in front of the second joint, the more obstructive the protruded part becomes. In a case where the writing tool is positioned at the back of the fingertip of the index finger, like the prior art, even if the tip of brush is positioned in the vicinity of the first joint when a finger is bent, the writing tool protrudes in front of the second joint by about 3 to 4 cm. Accordingly, the functions of expanding and contracting or advancing and retracting the writing tool are insufficient when the writing tool is positioned at the back of the fingertip of the index finger in the retained condition. Further, it is necessary to retract the writing tool to the same position as a further back second joint or to at least a site close to the second joint to be able to be attached in a held state.

Third, the orientation function and the posture stabilization function of the writing tool lack universal use. In the prior art, there is disclosure of the orientation function of retaining the writing tool at a predetermined angle and at a predetermined position without failing to reach or overextending beyond the predetermined position. In addition, in the prior art, as means for achieving the posture stabilization function to disallow the posture of the writing tool to collapse even if a thumb is released from the writing tool, a hemispherical depression member and a hemispherical protrusion are provided in the linking member or a triangular depression and a triangular protrusion are provided instead. Consequently, due to an engagement effect of these members, the writing tool has been stably positioned at one point, at a predetermined angle, and at a predetermined position (refer to paragraphs [0019] and [0021] and claims 1 and 2 of the prior art).

However, with respect to the angle of the writing tool at which the comfortability in the written condition is obtained, there is an individual difference from a person to a person depending on one's habits and preferences even in a normal range of writing posture. Therefore, if the writing tool is fixed to one point of the predetermined angle, a person who is unfamiliar with the angle may feel unnatural. In order for more persons to adaptably employ the writing tool, the posture stabilization function having both stability and universal use, that is, the function capable of being employed at a preferred angle and degree of inclination while maintaining the posture of the writing tool is more desirable than a mere fixing action to disallow the posture of the writing tool to be deformed even if a thumb is released.

An object of the present invention is to solve the problems of the prior art described above. The present invention improved and upgraded three functions, that is, the function of advancing or retracting and expanding or contracting the writing tool, the orientation function, and the posture stabilization function that have been insufficient in the five functions of the prior art. The present invention provides a writing tool for mounting on a finger and a writing tool finger holder including a part for mounting on a finger having a novel deforming function which achieves deformation into shapes convenient for transportation, carrying and storage. The writing tool in the retained condition can be retracted up to the same position as the second joint of the index finger or at least a site close to the second joint to be attached in a held state. In addition, the writing tool in the written condition not only keeps stability to an extent such that the posture of the writing tool does not collapse even if a thumb is released, but also has adaptability to an extent such that the writing tool can be employed at a preferred angle within a predetermined width.

Means for Solving the Problems

Hereinafter, main means for solving the problems according to the present invention will be described. First, a writing tool for mounting on a finger will be described. The drawbacks of the prior art described above have a great causality with a concept of the invention in addition to a technical level at the time when the invention according to the prior art was made. The fundamental standpoint of the concept of the prior art was merely how an existing writing tool is mounted on a finger when in use. Therefore, the writing tool finger holder was first devised and then by extension of the devising, means for sandwiching the writing tool of the writing tool finger holder was replaced with the writing tool and then the writing tool for mounting on the finger was provided. Accordingly, the abovementioned drawbacks still remained unsolved (refer to paragraphs [0009] and [0016] of the prior art)

Meanwhile, in the present invention, the concept is changed from how an existing writing tool is mounted on a finger when in use, to what shape and structure the writing tool per se should have in order to be mounted on a finger when in use. The Inventors studied shapes, functions and structures that a writing tool dedicated for mounting on a finger should have without being bound to a conventional image of the writing tool. Then, the problems were solved by further applying the obtained results to the writing tool finger holder.

Specifically, first, with respect to a part for mounting on a finger, various members such as a stripe body having elasticity to enable the stripe body to be curled in a ring shape and a stripe body processed so as to be mutually deformed in a flat shape and a ring shape or a band body having adhesiveness is integrated with a linking member by means of axial contact, sandwiching, building-in or the like as a structure appended to the linking member. The part for mounting on the finger has a novel deformation function by which, when in use, the part for mounting on the finger is mounted on a finger by methods such as extraction, deformation, winding and insertion, and after removed from the finger, the part for mounting on the finger can be stored in the linking member again.

Next, a necessary shortest size of the writing tool in the written condition is calculated; the size is roughly divided into at least two parts which are a writing tool axis body and a cap, and one of them comes axial contact with the other or one of them is stored in the other; and in the written condition, the axis body and the cap are unfolded or expanded; the length in the written condition is kept in the retained condition; and the axis body and the cap are overlapped by folding or storing to form the shortest mode. Further, means for changing a direction of the writing tool or directing the protruding part to a wrist enables the writing tool in the retained condition to be retracted up to at least a site close to the second joint to be attached in a held state.

Then, the linking member is allowed to have a new structure. For example, the linking member has a double-wall structure in which the wall surface of the cap is sandwiched and comes into axial contact therewith, the length of the linking member is the same as the width of the part for mounting on the finger, and the rear shaft is positioned at a center of the linking member. Alternatively, the linking member is one plate-like body with which a tail part of the cap comes into axial contact. A rear end of the cap comes into contact with an upper wall of the linking member to obtain rotation of the writing tool or a protrusion is provided in either the tail part of the cap or the linking member. Subsequently, a rotation angle of the writing tool is determined due to the engagingly locking effect exerted by the protrusion to thereby freely enable a reverse movement of the writing tool within a predetermined angle without being fixed to one point.

In the writing tool finger holder, an existing writing tool can be neither folded nor turned. Therefore, the linking member is formed as one plate-like body instead of the cross-type telescopic arm according to the prior art, and one pulling arm is provided. In addition, an operation of the pulling arm enables retraction of the tip of the writing tool in the retained condition by approaching the second joint.

Effects of the Invention

The present invention attains the following advantageous effects according to the abovementioned modification:

1. In the carried condition, the part for mounting on the finger is deformed to thereby enable storage in the linking member, so that the entire writing tool becomes thin and convenient for transportation, carrying and storage;
2. The position of the tip of brush in the retained condition can be retracted up to at least a site close to the second joint of the index finger to be attached in a held state, so that the convenience in carrying out other operations is remarkably improved, and the integrity of the invention is enhanced;

3. Functions required by the writing tool are more easily achieved, the shape of the linking member and the set position of a linking axis are provided as required, so that the structure is more reasonable, and the manufacturing costs are reduced, resulting in easy production; and
4. The angle of the writing tool in the written condition is adaptable to user's preference, so that a confliction feeling is less likely to occur, and the versatility is enhanced.

EMBODIMENT OF THE INVENTION

Figure 1:
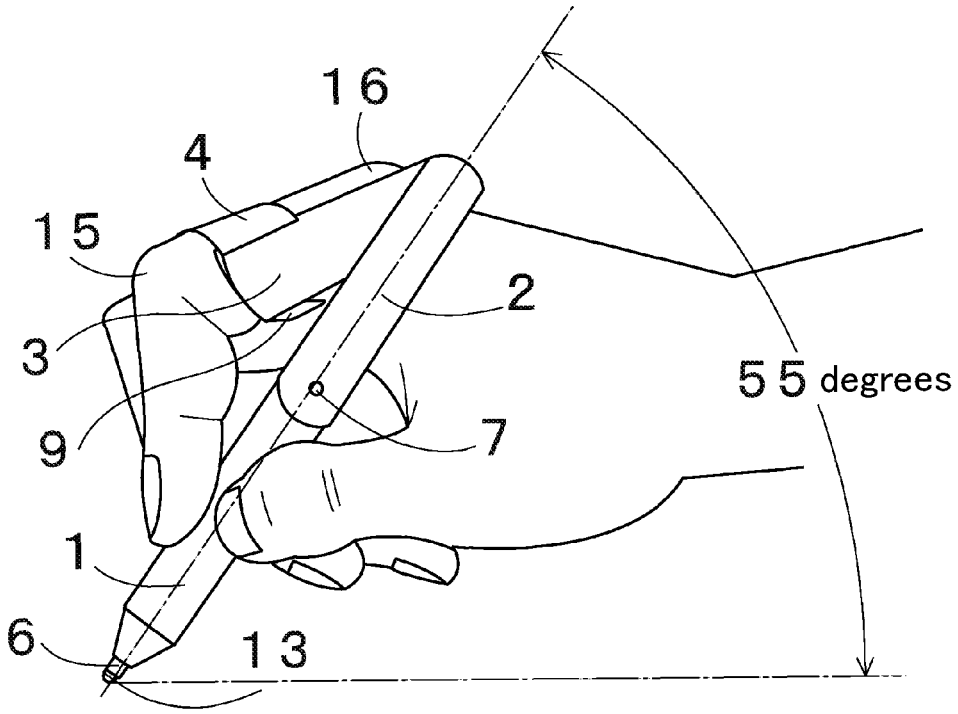
FIG. 1 is a side view showing a written condition according to Example 1.
Figure 2:
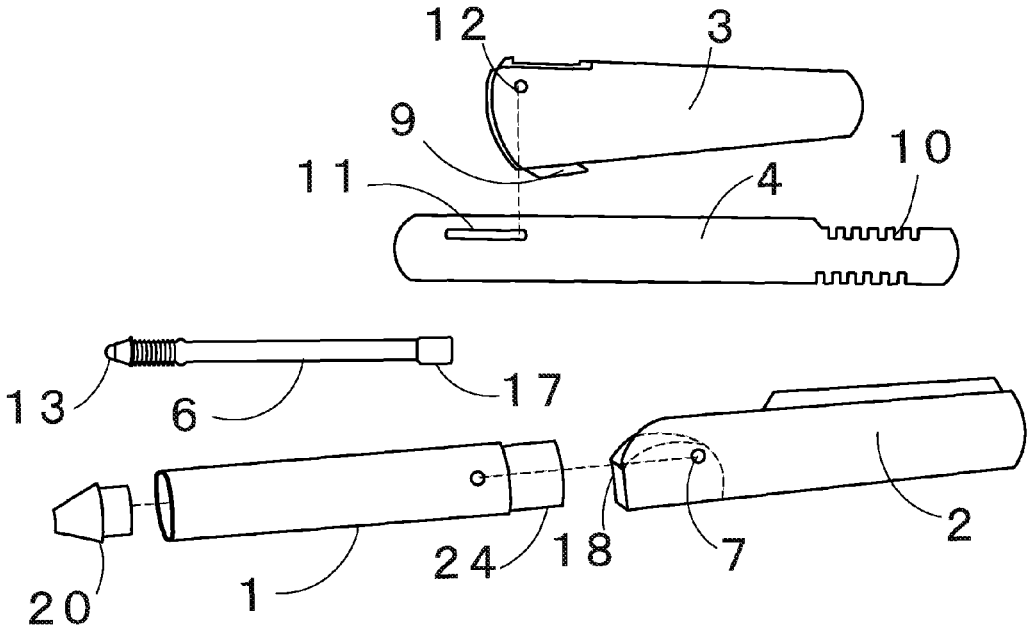
FIG. 2 is an exploded view showing a writing tool according to Example 1.
Figure 3:
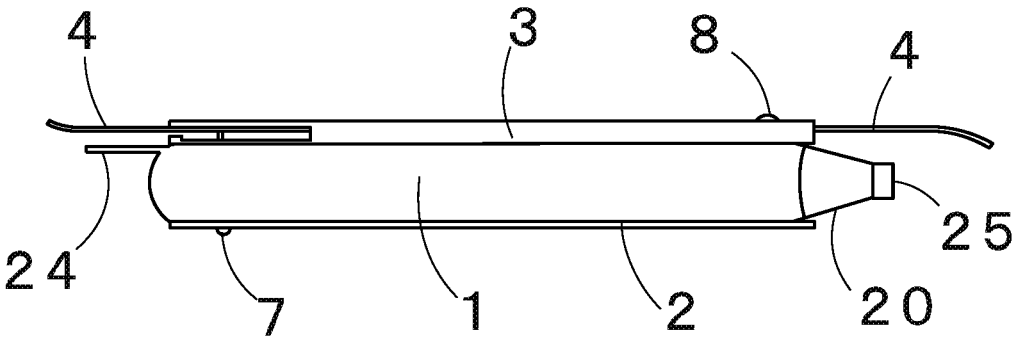
FIG. 3 is a top view showing the writing tool in a carried condition according to Example 1.
Figure 4:
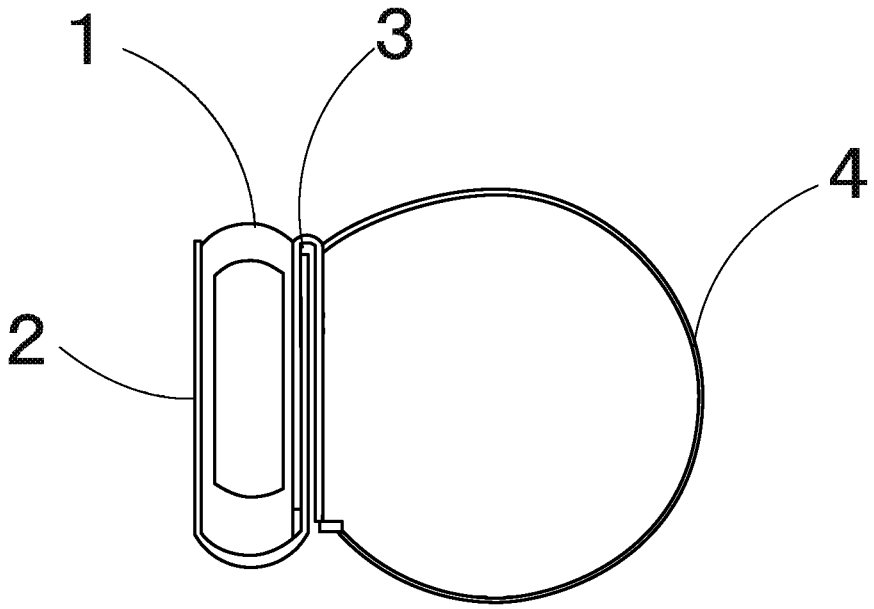
FIG. 4 is a rear view showing the writing tool in a retained condition according to Example 1.
Figure 5:
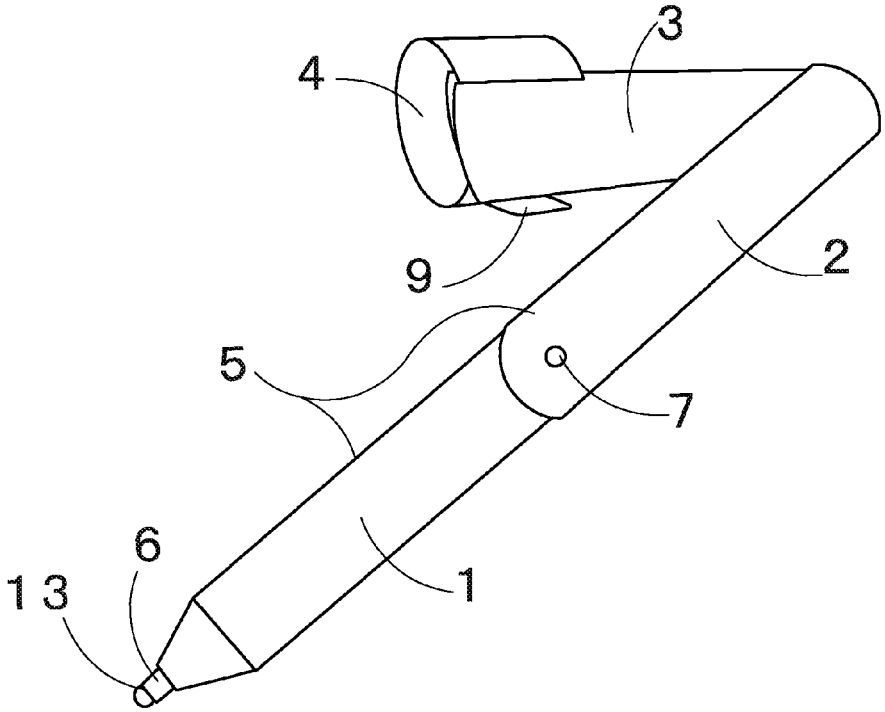
FIG. 5 is a side view showing the writing tool in a written condition according to Example 1.
Figure 6:
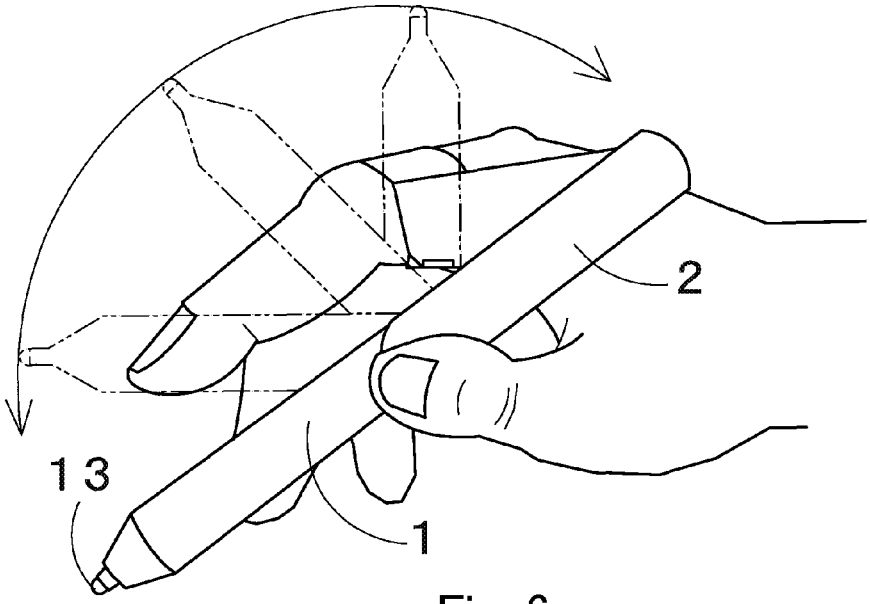
FIG. 6 is a diagram showing dynamics of the writing tool in condition switching according to Example 1.
Figure 7:
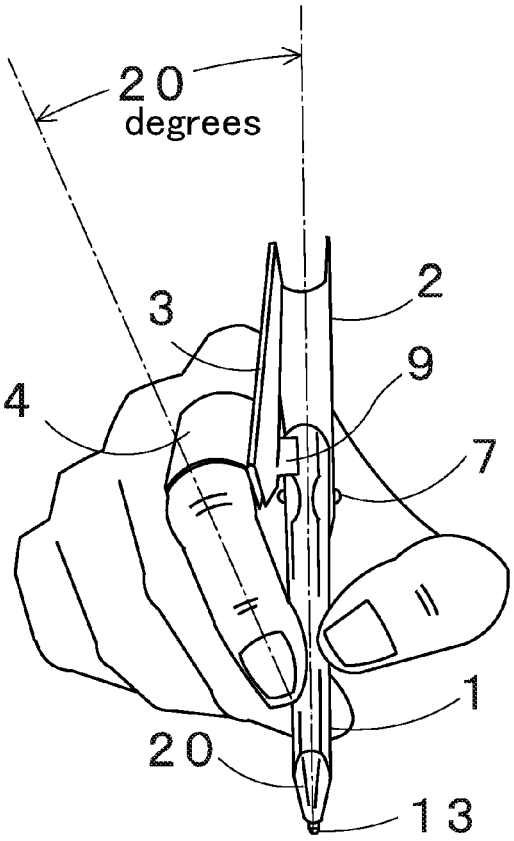
FIG. 7 is a diagram showing an inclination of the writing tool in the written condition according to Example 1.
Figure 8:
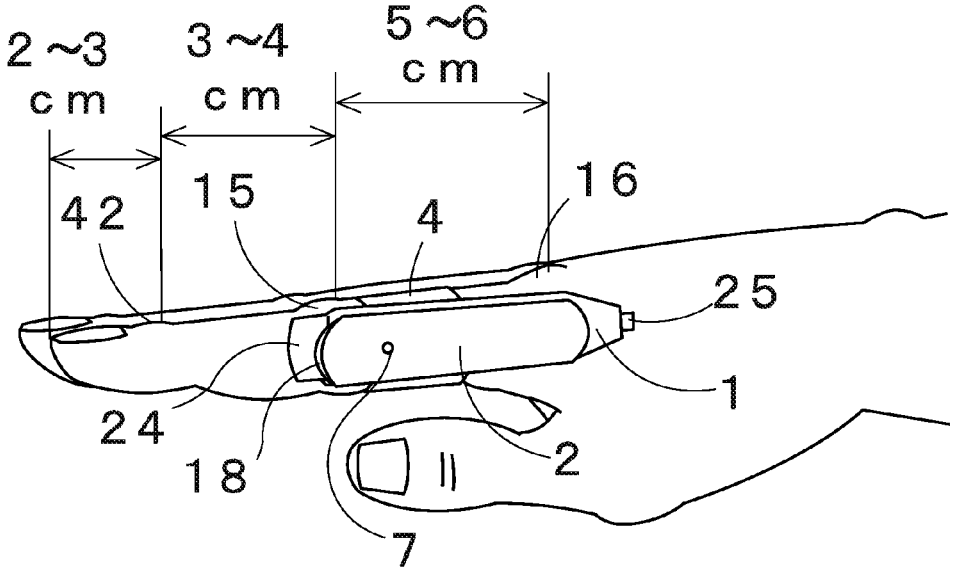
FIG. 8 is a diagram showing a condition in which fingers are straight in the retained condition according to Example 1.
Figure 9:
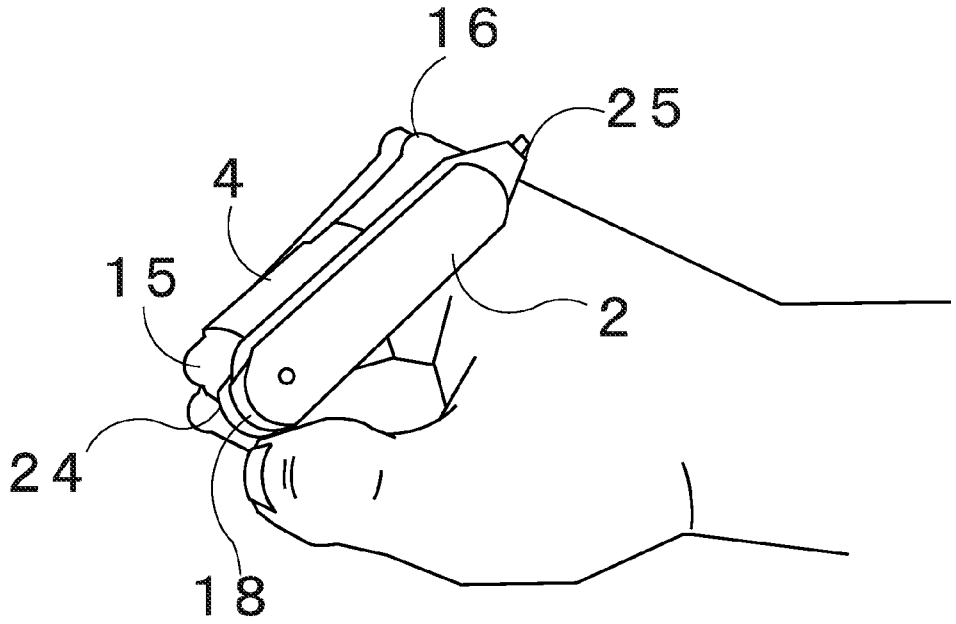
FIG. 9 is a diagram showing a condition in which fingers are bent in the retained condition according to Example 1.

Next, embodiments of the invention will be described. In order to keep the length of a writing tool in a retained condition as short as possible, first, a necessary shortest size of the writing tool in the written condition is calculated. The necessary shortest size of the writing tool in the written condition is determined as follows. That is, in a general writing posture considered to be a standard, a rear part of the writing tool can be made close to a root joint 16 of the index finger when the writing tool is gripped with three fingers including a thumb, an index finger, and a middle finger. A written condition can be set when a tip of the writing tool can protrude in front of a fingertip of the index finger by about 2 to 3 cm. Thus, if the length is considered to be the necessary shortest size of the writing tool in the written condition, the length is about 10 to 12 cm.

However, in a writing tool for mounting on a finger, the rear part of the writing tool comes into axial contact with a linking member. Therefore, only if a length required for forming an angle of the writing tool in the written condition can be ensured, there is no need to extend the writing tool up to a length at which the writing tool can be made close to the root joint 16. Accordingly, the length of the writing tool can be further shortened than the necessary shortest size of the writing tool in the written condition set when the writing tool is gripped with a bear hand.

In addition, the length from the second joint 15 to the root joint 16 of an index finger of a general adult is about 5 to 6 cm. Thus, if the length from the second joint 15 to the root joint 16 of the index finger is simply doubled, the length of the writing tool is made close to the necessary shortest size of the writing tool for preparing the written condition. Alternatively, if the necessary shortest size of the writing tool in the written condition is halved, the resultant length becomes the same as a distance from the second joint 15 to the root joint 16 of the index finger. The present invention utilizes a proportional relationship in which: the size of a standard type writing tool including an axis body and a cap is set to 5 to 6 cm; when both of the axis body and the cap are expanded, an overlapping part is made as short as possible and then the length of the writing tool in the written condition is ensured; and when the writing tool is folded or stored, a short writing tool in the retained condition is obtained by being preferably completely overlapped.

Also, there occurs a phenomenon that an angle of the writing tool in the written condition is changed depending on the length and diameter of the writing tool even if used by the same person. In addition, a difference in angle exerted by habits of a personal writing posture occurs. However, it is understood that the scope is generally within the range from 45 degrees to 65 degrees with respect to a paper surface. Therefore, according to the present invention, the angle of the writing tool in the written condition is specifically determined depending on the types with reference to the abovementioned range. Whatsoever angle of the writing tool may be, enablement of the reverse movement of the writing tool enhances the versatility.

The angle of inclination in the written condition is about 20 degrees, and the writing tool can sufficiently cross from an index finger side to a lower part of a fingertip. However, in a case where the writing tool is actually mounted on the index finger, it is understood that even a slight rotation of the part for mounting on the finger makes a great change at the angle of inclination of the writing tool mounted on the finger. Therefore, the angle of inclination in the written condition is set by the degree of tightness of each of the linked parts and the adjustment exerted by rotation of the part for mounting on the finger, without providing a dedicated engine.

Next, the respective members of the writing tool for mounting on the finger will be described. An axis body 1 is an essential part that directly acts on an object. The axis body 1 can be provided with a pen lead including a pencil lead, an ink tube, a tip or the like therein, depending on the property and type. Alternatively, various functions such as an electronic display, light and an eraser can be provided in other sites, and the contours can also be designed into various shapes in accordance with the structures.

The cap 2 mainly connects a linking member 3 and the axis body 1 to each other to allocate a length and an angle in the written condition, a degree of inclination, and a stability function or the like of the writing tool. In the retained condition, both of the linking member 3 and the axis body 1 are allowed to be overlapped by folding with the axis body 1 and storing the axis body 1. The cap 2 also has functions such as a contracting function and a posture stabilization function of the writing tool. The shape can be variously changed in accordance with the shape of the axis body 1.

The linking member 3 includes a part for mounting on a finger 4, and connects the part for mounting on the finger 4 to the cap 2 to thereby have functions of forming and switching the written condition and the retained condition, switching of application, posture stabilization or the like. The part for mounting on the finger 4 keeps the convenience of operations upon mounting the writing tool on the finger, the comfortability of the finger after the mounting, and the stability of the writing tool in the written condition and the retained condition. This mounting part is also allowed to have a deforming function of compactly storing the writing tool in a tip part of the linking member after the writing tool has been removed from the finger. In a case where a series of products are manufactured, the part for mounting on the finger is made detachable, and all of the series of products are commonly available as well.

Next, the writing tool finger holder will be briefly described. The writing tool finger holder is available for use in an existing writing tool. The basic structures of the part for mounting on the finger and the linking member each are similar to that of the abovementioned writing tool for mounting on a finger. In the structures described above, instead of the axis body 1 and the cap 2, a sandwiching means capable of sandwiching the existing writing tool is provided, and can be applied to the existing writing tools of various materials and patterns.

Hereinafter, some examples of the present invention will be described with reference to the drawings by taking a ball pen as a main example. It is to be noted that the technical concept of the present invention is not limited to the following examples, since the technical concept thereof can be applied to various types by changing means or a structure as well as changing the structure or shape depending on the function or material of the writing tool.

Example 1

The present example describes a writing tool for mounting on a finger, in which the linking member 3 sandwiches the part for mounting on the finger 4 and then is brought into axial contact therewith, and the axis body 1 and the cap 2 are thereby made foldable. FIG. 1 to FIG. 9 are the drawings related to Example 1.

The part for mounting on the finger 4 includes a stripe body made of a material such as a thin metal having elasticity. At each side edge of one end of the part for mounting on the finger 4, stopper teeth 10 is provided, and at the other end, a transverse groove 11 is provided, with the side groove 11 being an axis hole. In addition, the stripe body is sandwiched between the both walls of the tip end of the linking member 3. The part for mounting on the finger 4 is brought into axial contact with the linking member 3 by a mounting tool axis 12. The linking member 3 has a double wall obtained by folding one flat plate and then opening three surfaces which are the front, rear and lower surfaces. At the rear part of the double wall, an inner side wall at the index finger side of the cap 2 is sandwiched therebetween, and the linking member 3 is brought into contact with the cap 2 by a linking axis 8 (hereinafter, referred to as a rear axis 8) to link the linking member 3 and the cap 2 with each other (Refer to FIG. 2 and FIG. 3).

The axis body 1 forms an elliptic cylinder shape of the writing tool of a standard size in the retained condition. Also, a base 20 is provided in front of the shell formed in the elliptic cylinder shape, and a pen lead 6 provided with a tip in front of an ink storage tube is built in the shell. In addition, a spring is inserted into the tip, and the pen lead 6 is always biased backward. Then, axis holes are provided in both of the left and right walls of the axis body 1, and the axis body 1 is brought into contact with the cap 2 by the linking axis 7 (hereinafter, referred to as a front axis 7). At a tail part of the axis body 1, a tail wall 24 is provided which is obtained by expanding the wall of the shell at the index finger side of the axis body 1 by about 1 cm backward from the axis hole (refer FIG. 2 and FIG. 3).

An upper surface and front and rear surfaces of the cap 2 are opened, and both sides and bottom surfaces are wall surfaces. Among the three surfaces, a part of a front wall of an inner wall at the thumb side is cut out, so that the tail wall 24 of the axis body 1 is rotated without difficulty. The rear part is sandwiched between both walls of the rear part of the linking member 3, and comes into axial contact with the linking member 3. When the cap 2 is rotated, a tail end thereof comes into contact with an upper wall of the linking member 3, and the cap 2 is thereby provided so that the rotation of the cap is stopped at a required angle in the written condition. Then, at a front lower part of the wall surface of the thumb side of the linking member 3, a protruding part 9 which protrudes at the thumb is provided.

Further, around the axis hole for the front axis 7 at the front part of the bottom surface of the cap 2, an axis protrusion part 18 is provided. The axis protrusion part 18 forms oval-shaped outer edges, each of which has a size corresponding to a space width of the shell of the axis body 1 and at which the axis body 1 can be rotated without difficulty. The outer edges are provided while being biased from the axial center so that a front outer edge of the oval is far away from an axial center of the front axis 7 and a rear outer edge is near the axial center of the front axis 7. Then, in a state in which the axis protrusion part 18 is built in the shell of the rear part of the axis body 1, the axis body 1 is brought into axial contact with one wall surface of the cap 2 at the thumb side by the front axis 7, and the axis body 1 is rotated about the front axis 7 from the upper surface, enabling folding with the cap 2 (refer to FIG. 3 and FIG. 4).

The writing tool for mounting on the finger of the present example is formed as described above. When the writing tool for mounting on the finger is used, first, the stripe body of the part for mounting on the finger 4, exposed in the rear end of writing tool main body 5 in the carried condition, is rotated until the stripe body becomes perpendicular to the writing tool main body 5 and then is pulled down, and a part protruding in front of the writing tool is lowered. Therefore, the stripe body is further rotated by 180 degrees. Afterwards, the stripe body is wound between the second joint 15 and the root joint 16 of the index finger, and the stripe body is inserted between double walls of the linking member 3 from a lower side. Further, the locking teeth 10 are hooked onto each side of the linking member 3 and then are fixed to the finger. Subsequently, the writing tool is set in the retained condition in which the tip of brush 13 is slightly protruded around the root joint 16 and the tail wall 24 is slightly protruded in front of the second joint 15 in a state in which the axis body 1 is folded in the cap 2 (refer to FIG. 3, FIG. 8, and FIG. 9).

When the retained condition is switched to the written condition, if the thumb is raised around the second joint 15 of the index finger and then pushed down while being abutted against a front region of the cap 2, the cap 2 is lowered while rotating around the rear axis 8. Then, the axis body 1 brought into axial contact with the cap 2 is about to be lowered together with the cap 2. However, the axis body 1 is blocked by the protruding part 9 provided with the linking member 2, and the axis body 1 is rotated around the front axis 7 as a fulcrum while being raised up by the protruding part 9 according to the principle of leverage. Subsequently, when the cap 2 has been lowered by an angle of the written condition, the axis body 1 and the cap 2 are also linearly expanded and stretched to a standard length of the written condition (refer to FIG. 5).

In the written condition, a tail valve 17 of the pen lead 6 comes into contact with the outer edge far away from the axial center of the front axis 7 of the axis protrusion part 18. Therefore, the tail valve 17 is protruded in front of the shell protruded while rotating around the same fulcrum, that is, the front axis 7, and then, the tip of brush 13 is protruded in front of the base 20, resulting in a writable state. At that time, the rear end of the cap 2 that is sandwiched between the double wall surfaces of the linking member 3 by the rear axis 8 is abutted against the upper wall of the linking member 3, so that rotation of the cap 2 is stopped at a position at which the angle of the cap 2 with reference to the paper surface that is a standard angle in a predetermined written condition is about 75 degrees. Thus, even if the thumb is released, the posture does not collapse. Accordingly, the posture is easily and reliably made stable without a semispherical or triangular member as in the prior art. In addition, the angle can be returned in the range of the predetermined angle, and the angle can be thereby adjusted according to a user's preference (refer to FIG. 1, FIG. 6, and FIG. 7).

Further, both walls of the linking member 3, sandwiching both the wall surfaces of the stripe body and the cap 2 in the retained condition, sandwich only the wall surface of the cap 2 in the written condition. Therefore, in this manner, a backlash is generated in the cap 2, thus enabling sufficient adjustment of the degree of inclination. In addition, the tail valve 17 of the pen lead 6 in the written condition comes into contact with the outer edge far away from the axial center of the front axis 7 of the axis protrusion part 18, so that the resilience of the spring allows a linear state of the writing tool to be stabilized. Even in a case where the linear state is unstable, it is sufficient if simple fixing means is provided, for example, a magnet is provided at a part where the axis body 1 and the cap 2 come into contact with each other, thereby adsorbing both of them.

When the written condition is switched to the retained condition, if the thumb, the index finger, and a middle finger gripping the writing tool are released from the writing tool and then the center of the cap 2 or its periphery is pushed with only the thumb, the writing tool main body 5 in the linear state is raised while rotating around the rear axis 8. When the tail wall 24 of the axis body 1 comes into contact with the protruding part 9, the axis body 1 is pressed by the protruding part 9 according to the principle of leverage and then is rotated, with the front axis 7 being a fulcrum. In a state in which the tip of brush 13 is oriented to a wrist, the axis body 1 is folded with the cap 2 and then is set in the retained condition (refer to FIG. 5 and FIG. 8).

In the retained condition, the tail valve 17 of the pen lead 6 is abutted against the outer edge of the axis protrusion part 18 close to the axial center of the front axis 7, so that the pen lead 13 becomes shorter than the shell of the axis body 1 and then is concealed in the base 20. Afterwards, the protruding part 9 is sandwiched between the bottom surface of the cap 2 and the axis body 1 that is rotated from the upper surface and then is made stable in the retained condition. Consequently, interference with other operations by the writing tool can be avoided even if the other operations is carried out while the writing tool is mounted on the finger (refer to FIG. 9).

When the writing tool is removed from the finger, if the stripe body of the part for mounting on the finger 4, inserted into the linking member 3, is laterally slid, the locking teeth 10 is unhooked, and the stripe body is returned to be flat by its own elasticity. Afterwards, the stripe body is rotated in a direction opposite to that when the stripe body is mounted on the finger and then is inserted between the double walls of the linking member 3 again. Subsequently, the stripe body is overlapped with one wall surface of the cap 3 sandwiched between the double walls of the linking member 3, which leads to a compact carried condition (refer to FIG. 3).

In the present example, instead of allowing the axis body 1 to be rotated according to the principle of leverage, it is possible to rotate the front axis 7 by using a gear or a belt. However, the use of such a mechanism lacks subtleness as compared with use of the principle of leverage in spite of the fact that the structure is more complicated than that of the present example. In addition, the double walls of the linking member 3 are flat surfaces. Therefore, there are advantages that the linking axis does not always need to be provided under the center line in order to link the cap and the linking member that are cylindrical members as disclosed in the prior art, and the linking axis can be freely set in a required place or the like.

In addition, in the present example, a spring has been used as means by which the pen lead 6 is always biased backward in order to conceal the tip of brush 13 in the retained condition. Meanwhile, there is another method in which a magnet is provided in the axis protrusion part 18 and/or the tail valve 17, and the both of them are attracted by an attracting power of the magnet. Also, there is still another method in which both of the axis protrusion part 18 and the tail valve 17 are linked so that both of the axis protrusion part 19 and the tail valve 17 can be rotated while being always kept in contact with each other. However, these two methods have a disadvantage that a friction occurs between each of the outer edges of the tail valve 17 and the axis protrusion part 18, and produces an inhibiting force between the axis protrusion part 18 and the tail valve 17. Therefore, it is also possible to disallow the axis protrusion part 18 to be provided in the axis body 1, and the tip of brush 13 in the retained condition is oriented to the wrist side and then is kept to be exposed. As described above, various types of foldable writing tools can be implemented in full consideration of the advantage and disadvantage.

Example 2

Figure 10:
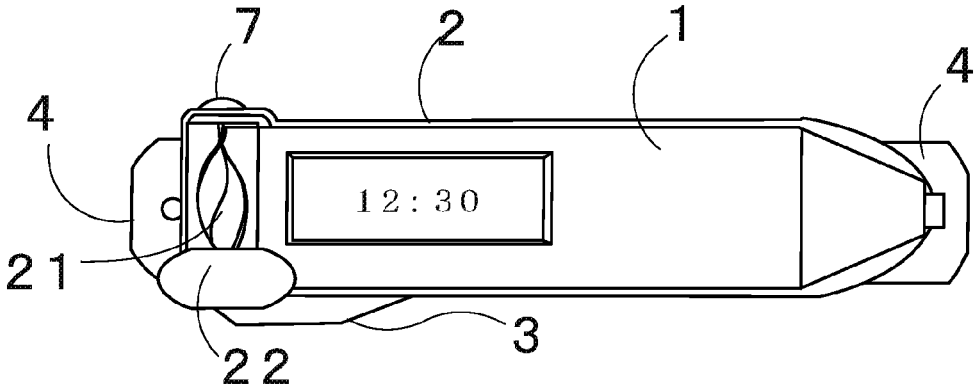
FIG. 10 is a side view of the writing tool in the carried condition according to Example 2.
Figure 11:
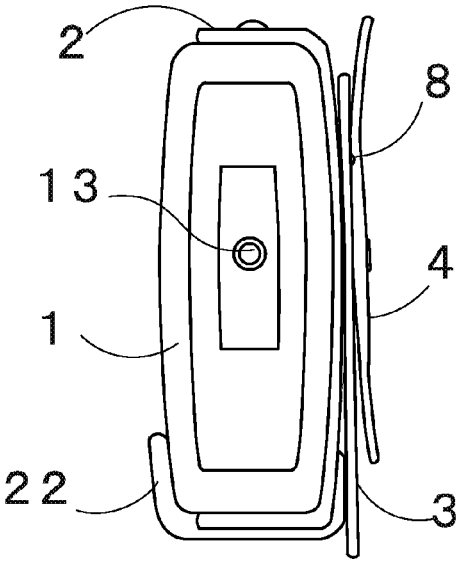
FIG. 11 is a rear view of the writing tool in the carried condition according to Example 2.
Figure 12:
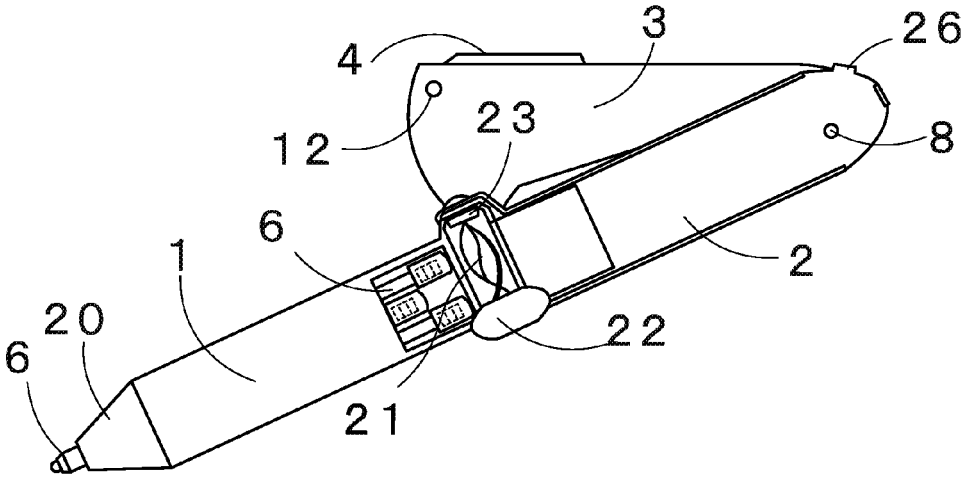
FIG. 12 is a side view of the writing tool in the written condition according to Example 2.
Figure 13:
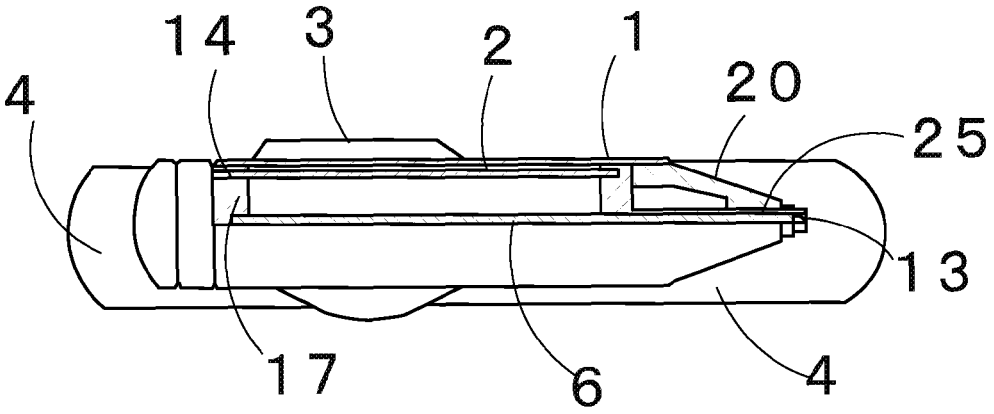
FIG. 13 is a partial cross-sectional side view of the writing tool in the carried condition according to Example 3.
Figure 14:
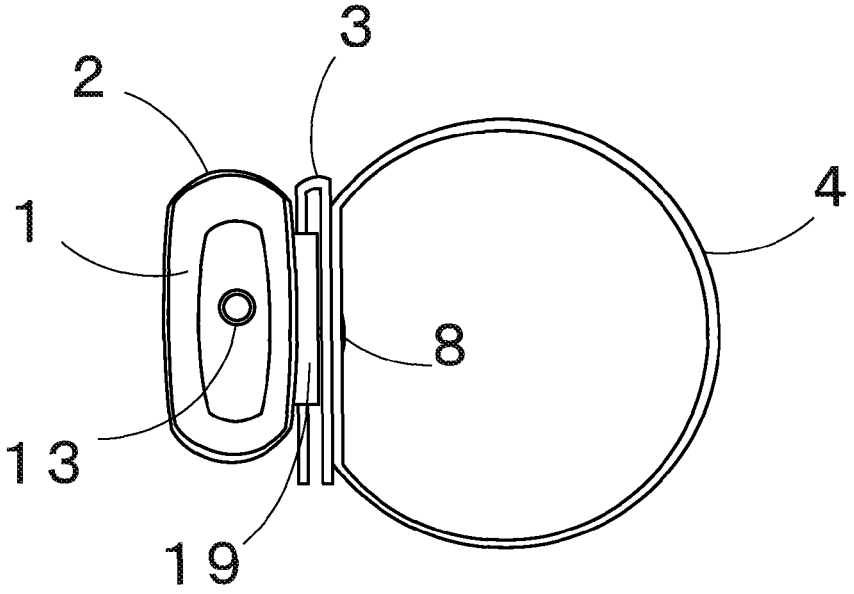
FIG. 14 is a rear view of the writing tool in the retained condition according to Example 3.
Figure 15:
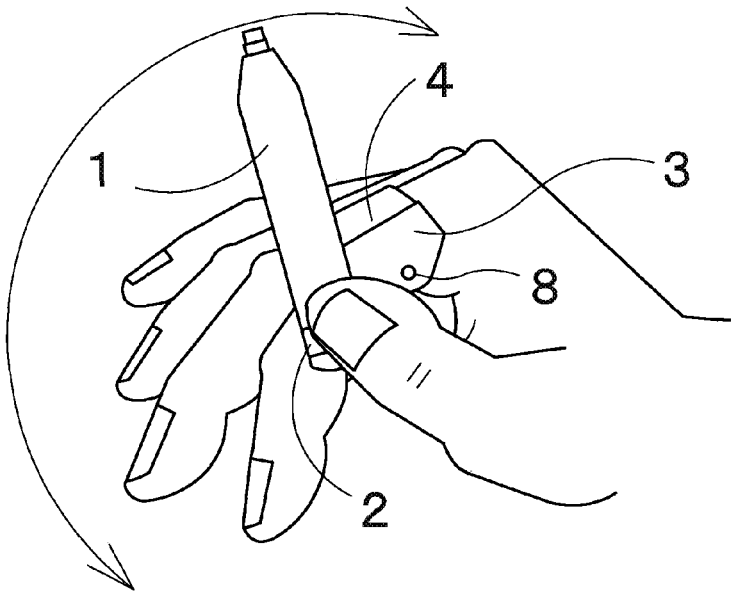
FIG. 15 is a diagram showing dynamics of the writing tool in condition switching according to Example 3.
Figure 16:
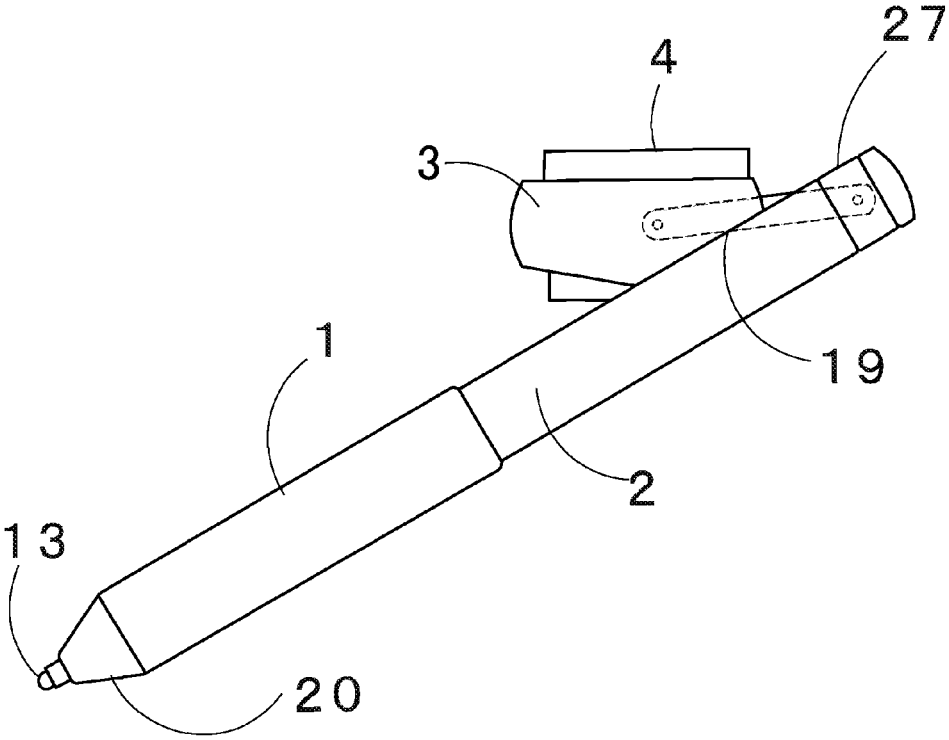
FIG. 16 is a side view of the writing tool in the written condition according to Example 3.

The present example describes a writing tool for mounting on a finger, made foldable by bringing a metal stripe body alternately deformable in a ring shape and a flat shape into rotatable axial contact with the linking member 3 to thereby enable the axis body 1 to be opened and closed from the side surface of the cap 2. FIG. 10, FIG. 11, and FIG. 12 are the drawings related to Example 2.

The part for mounting on the finger 4 is integrated with the linking member 3 by processing the metal stripe body so that an intermittent part is slightly protruded with respect to each side edge. Also, the metal stripe body is instantly curled merely by applying a slight press so that the intermittent part comes into axial contact with the front part of the linking member 3. The linking member 3 has a flat plate-like body of which size is roughly the same as that of the cap 2, and the wall surface of the cap 2 at the index finger side is brought into axial contact with the rear part of the plate-like body by the rear axis 8. In addition, on the wall at a front lower part of the linking member 3, a sandwiching member 23 protrudes at the thumb side and further the sandwiching member 23 has a rectangular hole at a center part thereof.

At the shell having a square pole shape of a standard size of the writing tool in the retained condition of the axis body 1, pen leads 6 having three different colors of their own are provided in parallel to each other, and the colors are selected by operation of advancing and retracting the pen leads with the thumb. At the rear part of the axis body 1, a spiral tail valve 21 is provided, and the spiral tail valve 21 is sandwiched therebetween so that the spiral tail valve 21 can be vertically moved in the rectangular hole provided in the sandwiching member 23. In addition, at the shell of the axis body 1, a small electronic watch is provided, and a display is mounted on the wall surface at the thumb side of the axis body 1 in the retained condition (refer to FIG. 10, FIG. 11, and FIG. 12).

Of the cap 2, the thumb side is opened, three surfaces as the index finger side surface and upper and lower surfaces are wall surfaces, and the wall of the rear part of the index finger side comes into axial contact with the linking member 3. However, on the side wall of the rear part, a protrusion part 26 for limiting the rotation angle is protruded. Then, a part of the front end of the side wall is removed, only the upper and lower walls are expanded to the tail end with which the spiral tail valve 21 of the axis body 1 is brought into axial contact by the front axis 7, and the axis body 1 is opened and closed from the side surface. At a lower part of the front axis 7, a knob 22 is provided. The knob 22 is always biased upward by an elastic force of the spring to thereby lock the axis body 1 with the cap 2, and has a stabilization function (refer to FIG. 10, FIG. 11, and FIG. 12).

The writing tool according to the present example is formed as described above. While in practical use, the part for mounting on the finger 4, turnably attached to the linking member 3 in parallel, is rotated until the part for mounting on the finger 4 becomes perpendicular to the linking member 3 and then is slightly pressed while being abutted against a site between the second joint 15 and the root joint 16 of the index finger, and the stripe body is thereby instantly curled and wound around the index finger. Subsequently, the axis body 1 orients the tip of brush 13 to the wrist and then is overlapped with the cap 2, and the writing tool is set in the retained condition in parallel to the index finger.

When the retained condition is switched to the written condition, if the knob 22 is pressed down with the thumb being abutted against the knob, the knob 22 is lowered and then the axis body 1 is unlocked. At the same time, the cap 2 is lowered while rotating around the rear axis 8 as a fulcrum. Then, due to the engaging effect of the sandwiching member 23 provided in the linking member 3, the spiral tail valve 21 sandwiched between the rectangular holes is rotated, and the axis body 1 is thereby opened from the side surface of the cap 2 with the front axis 7 being a fulcrum and then the retained condition is switched to the written condition in which the axis body 1 is linear with respect to the cap 2. Afterwards, the sandwiching member 23 is moved from the lower surface to the upper surface of the spiral tail valve 21, the protruding part 26 of the writing tool main body 5 is blocked by the wall of the tail part of the linking member 3, and the rotation is stopped at a predetermined angle in the written condition. Subsequently, the writing tool can be freely returned at a certain angle within the predetermined angle to thereby enable a comfortable posture to be kept in accordance with a preferred angle (refer to FIG. 12).

Then, at the tail end of the axis body 1, the tail valves of the three pen leads 6 are exposed, so that one of the selected valves is pressed forward with the thumb, and the pressed tip of brush 13 is advanced and protruded in front of the base 20. Afterwards, the cap 2 and the linking member 3 come into axial contact with the rear axis 8, and the spiral tail valve 21 of the axis body 1 is also engaged with the sandwiching member 23, so that the writing tool main body 5 is locked again and then is stabilized due to the spring effect of the knob 22 in a state in which the required length, angle and degree of inclination fit to the written condition (refer to FIG. 12).

When the writing condition of the writing tool is switched to the retained condition, once the knob 22 is lowered with the thumb and then is pushed up after unlocked, a reverse movement is carried out when the retained condition is switched to the written condition while the cap 2 is pushed up, and the axis body 1 is thereby folded from the side surface of the cap 2 and then is set in the retained condition. At that time, the tail valve of the pen lead 6 protruding forward in the written condition is retracted by coming into contact with the circumference edge of a cut end of the side surface wall of the cap 2, and the writing tool is set in the retained condition in a state in which all of the tips of brush 13 of the three pen leads 6 are concealed in the axis body 1 (refer to FIG. 10).

When the writing tool is removed from the finger, if one end of the curled stripe body is pressed outward, the stripe body is returned to be flat by its own elastic force. Thus, the stripe body is rotated so as to be parallel to the linking member 3 and then is overlapped with the linking member 3. According to the present example, there are advantages that a thickness of the axis body 1 is easily made thin, a width of the axis body 1 is easily made wide, and a surface of the axis body 1 is easily made flat. Therefore, it is possible to easily add functions in accordance with various applications. In other words, it is possible to provide a plurality of pen leads or to provide a watch, light, an electronic display, a terminal function or the like.

Example 3

The present example describes a writing tool for mounting on a finger, in which the setting conditions are switched by linking the linking member 3 with the cap 2 via a linking supporting member 19, providing the rear axis 8 in the center part of the linking member 3, and moving the cap 2 in the forward and backward directions of the rear axis 8 via the linking supporting member 19. FIG. 13 to FIG. 16 are the drawings related to Example 3.

At the part for mounting on the finger 4, like Example 2 described above, a stripe body capable of alternately deforming into a ring shape and a flat shape is brought into axial contact with the index finger side of the linking member 3. In addition, the linking member 3 has a double wall, like Example 1 described above. However, the length of the linking member 3 is the same as the width of the stripe body of the part for mounting on the finger 4, the rear axis 8 is provided at the center of the linking member 3 with which one end of the linking supporting member 19 is allowed to be sandwiched in axial contact, and the other end of the linking supporting member 19 comes into axial contact with the rear part of the cap 2.

The axis body 1 forms an elliptic cylinder shape having a standard size of the writing tool in the retained condition, pen leads 6 are provided in the elliptic cylinder shape shell, and the tail valve 17 of the pen leads 6 is fixed to the tail part of the axis body 1, whereas in the tail valve 17, holes 14 are provided at upper and lower parts thereof. On the other hand, the cap 2 is slightly thinner than the axis body 1 and has a longer elliptic cylinder shape. Intermittent parts of the oval cylindrical shape are connected to each other by two axes provided in the upper and lower parts, and the two axes are inserted into axis body 1 from the hole 14 provided in the tail valve 17. Also, the axis body 1 and the cap 2 are inserted so as to smoothly slide in the front and rear directions. At the front end of the two axes of the cap 2, a lead protective tube 25 is provided. The lead protective tube 25 enables the axis body 1 and the cap 2 to slide between the base 20 and the pen leads 6 in the forward and backward directions. In addition, the rear part of the cap 2 is brought into axial contact with one end of the linking supporting member 19 of the tail valve. Further, the cap 2 is fixed by adjusting an angle so that the rotation is stopped at a required angle in the written condition (refer to FIG. 13, FIG. 14, and FIG. 16).

The writing tool of the present example is formed as described above. When the writing tool is used, the part for mounting on the finger 4, provided in the linking member 3, is rotated so as to face upward, like Example 2 described above, and is wound in the index finger to become the retained condition. In the retained condition, in a state in which the cap 2 is inserted into the axis body 1, the tip of brush 13 is concealed into the lead protective tube 25 protruding in front of the base 20. The cap 2 is folded with the linking supporting member 19, the tail end is positioned around the second joint 15 of the index finger, and the tip end is positioned around the root joint 16, respectively.

When the retained condition is switched to the written condition, if the rear part of the cap 2 is lowered with the thumb, the cap 4 is rotated around the rear axis 8 as a fulcrum via the linking supporting member 19. The rear part of the cap 2 is moved from the front side of the rear axis 8 to the rear side of the rear axis 8, and the axis body 1 facing the rear side of the rear axis 8 from the upper side in the retained condition is changed to face the front side of the rear axis 8 from the lower side. In addition, the cap 2 and the linking supporting member 19 are opened at a predetermined angle in the written condition. At the same time, axis body 1 is protruded in front of the outside of the cap 2 by its own weight and a centrifugal force at the time of rotation and then is expanded to the length in the written condition. The linking supporting member 19 sandwiched between the double walls of the linking member 3 has the degree of inclination that is naturally formed at intervals between the double walls. In addition, the writing tool main body 5 adjusts the angle, the degree of inclination, and the length, and enables a reverse movement and thus a comfortable written condition is set (refer to FIG. 15 and FIG. 16).

When the written condition is switched to the retained condition, if the cap 2 is lowered while the thumb is abutted against the tail valve of the cap 2 close to the root joint 16, by the reverse the movement to that at the time of switching the retained condition to the written condition, the tail end of the cap 2 is moved from the rear side of the rear axis 8 to the front side of the rear axis 8. When the tail valve of the cap 2 passes through the lower part of the rear axis 8, when the writing tool main body 5 is perpendicular, the rotation speed of the linking supporting member 19 is reduced due to the friction of both side walls of the linking member 3. Therefore, at that moment, the axis body 1 protruding in front of the cap 2 slides down due to its own weight and then the cap 2 is inserted into the axis body 1. Then, the lead protective tube 25 protrudes in front of the base 20, and the tip of brush 13 is concealed in the lead protective tube 25. Subsequently, when the cap 2 is rotated by the front side of the rear axis 8, the cap 2 is inserted into the axis body 1, and the writing tool is set in the retained condition in a state in which the writing tool main body 5 is contracted (refer to FIG. 14 and FIG. 15).

When the writing tool is removed from the finger, if a slight press is applied to both ends of the stripe body of the part for mounting on the finger 4 to return to be flat, the part for mounting on the finger 4 is rotated in a direction which is the same as the rotation direction of the cap 2, and the retained condition is switched to a compact carried condition. The writing tool according to the present example has a unique characterizing feature that it is possible to enjoyably fulfill a desire to repeatedly do simple pen spinning or the like. This is because operations such as switching of the written condition and the retained condition and advancing and retracting or expansion and contraction of the writing tool, reversion of orientation is enabled merely by an operation of lowering the tail valve of the cap 2 from the front side and the rear side of the rear axis 8 with the thumb (refer to FIG. 13).

Example 4

Figure 17:
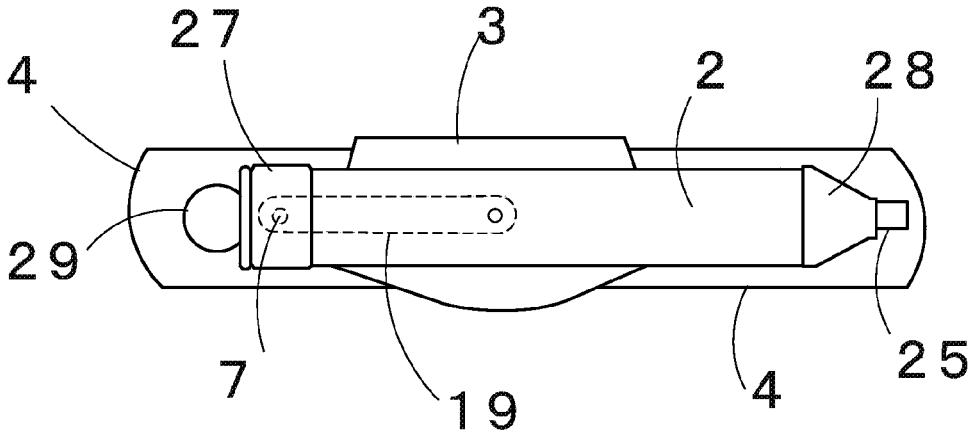
FIG. 17 is a side view of the writing tool in the carried condition, according to Example 4.
Figure 18:
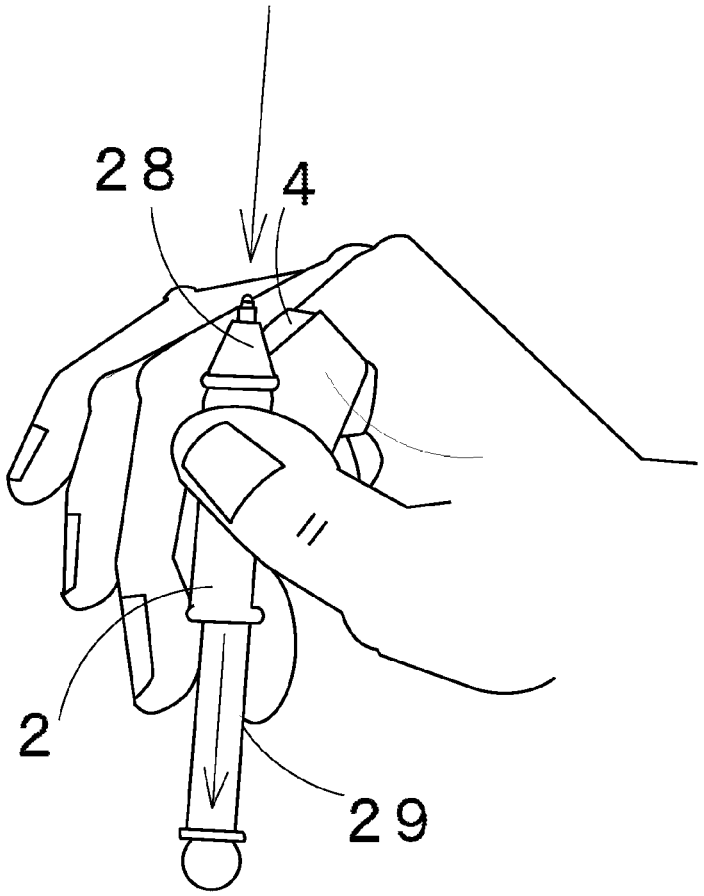
FIG. 18 is a diagram showing dynamics of the writing tool in application switching according to Example 4.

The present example describes a writing tool for mounting on a finger obtained by applying Example 3. The writing tool for mounting on the finger is different from that of Example 3 in that an axis body 1 is made of two cylindrical bodies having different uses of a ball pen 28 and a touch pen 29, and respective tips of brush 13 allow these two pens to be interposed on both ends of the cylindrical bodies of a cap 2, enabling switching of the uses of the ball pen 28 and the touch pen 29 as well as a position switch. FIG. 17 and FIG. 18 are the drawings related to Example 4.

Three cylindrical bodies of which lengths are approximately the same as each other and of which thicknesses are different from each other are interposed so that three layers are slidable, that is, an inner layer is slidable relative to the touch pen 29, an intermediate layer is slidable relative to the ball pen 28, and a top layer is slidable relative to the cap 2. Also, the tips of brush of the ball pen 28 and the touch pen 29 are respectively exposed from both ends of the cylindrical bodies of the cap 2. In addition, at the outer circumference of a respective one of the cylindrical bodies of the cap 2, a slip ring 27 is circularly provided so as to be forwardly and backwardly slidable, and the slip ring 27 is brought into axial contact with the linking member 3 by the rear axis 8 via the linking supporting member 19. In this manner, the writing tool main body 5 is made rotatable in the forward and backward direction of the rear axis 8 in a semicircular trajectory from the bottom about the rear axis 8 via the linking supporting member 19. Other operations are similar to those of Example 3 (refer to FIG. 17).

The writing tool of the present example is formed by the operation described above. If the operation is carried out, like Example 3, the writing tool can be used as the ball pen 28, and can also be used as the touch pen 29. When the writing tool is switched to the touch pen 29 while the written condition of the ball pen 28 is switched to the retained condition, when the writing tool main body 5 is vertically perpendicular if the thumb is positionally shifted from the tip of brush of the touch pen 29 to the top of the slip ring 27, the ball pen 28 of the intermediate layer, expanded on the top of the cap 2, is slipped down due to a gravitational force and then is inserted into the cap 2. At the same time, the cylindrical body per se of the cap 2 also slips down to the slip ring 27. Further, from the bottom of the cap 2, the touch pen 29 of the inner layer slips down from the inside of the cap 2 and then is expanded to the length of the written condition of the touch pen 29.

Then, the writing tool main body 5 becomes substantially parallel to a length from the proximity of a second joint 15 of an index finger up to the fingertip. However, in the case of the touch pen 29, a shell thereof is thinner than that of a general writing tool, and a tapping or sliding operation is often relative to the screen instead of transcribing. Therefore, unlike the general written condition, it is easier to use the touch pen while being lightly sandwiched between a thumb and the index finger as it is, without varying the angle or the degree of inclination of the pen, rather than to use the touch pen while being gripped with three fingers which are a middle finger, the index finger, and the thumb, with the tip of brush 13 being inclined so as to be under the index finger. Hence, this writing tool may be used as a touch pen as it is (refer to FIG. 18).

In addition, when the touch pen 29 is switched to the ball pen 28, if the cylindrical body is rotated by about 180 degrees while the thumb is abutted against the rear part of the cylindrical body of the cap 2, the writing tool main body 5 is moved from the front side of the rear axis 8 to the back side of the rear axis 8, and the positions of the ball pen 28 and the touch pen 29 are reversed. Subsequently, the touch pen 29 drops due to its own weight and then is inserted into the cylindrical body of the cap 2. At the same time, the ball pen 28 slips down from the inside of the cap 2 and then the writing tool switches to the ball pen 28. In addition, if the thumb is temporarily released from the cylindrical body of the cap 2, the cylindrical body per se of the cap 2 slips down to the slip ring 27 as well. At the same time, the writing tool main body 5 is obliquely inclined due to the weight of the cylindrical body of the ball pen 28 and then the angle and length of the written condition of the ball pen 28 are obtained.

The degree of inclination in the written condition of the present example can be formed by turning the slip ring 27 that connects the cap 2 and the linking member 3 to each other and the part for mounting on the finger and thus there is no need to provide a specific mechanical engine in particular. The operations for releasing the writing tool from a finger or the like are the same as those in Example 3.

Example 5

Figure 19:
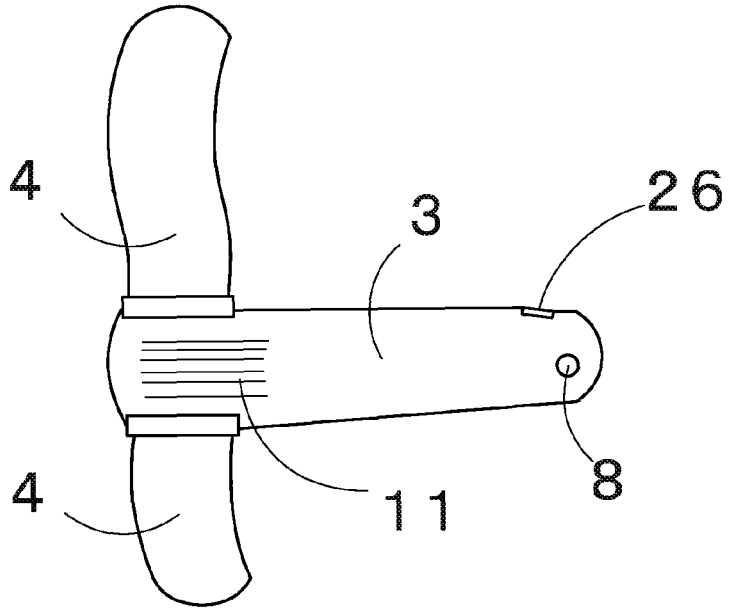
FIG. 19 is a side view showing a part for mounting on a finger and a linking member according to Example 5.
Figure 20:
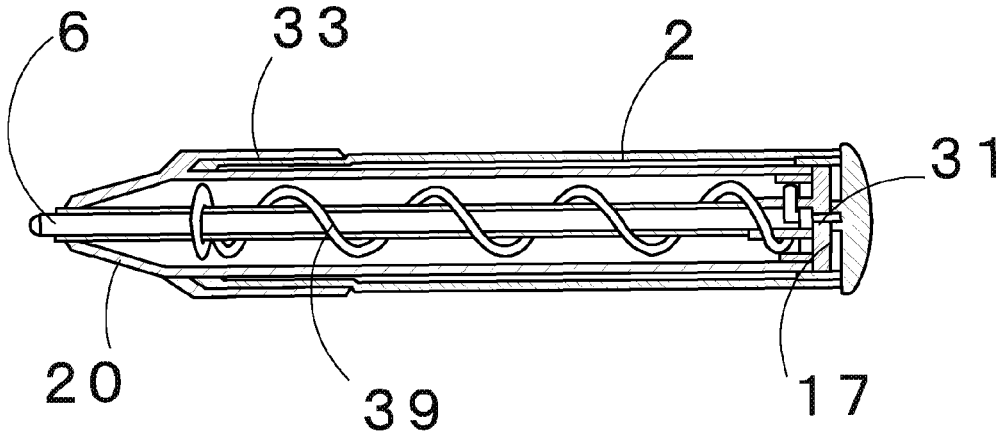
FIG. 20 is a partial cross-sectional side view showing the writing tool in the retained condition according to Example 5.
Figure 21:
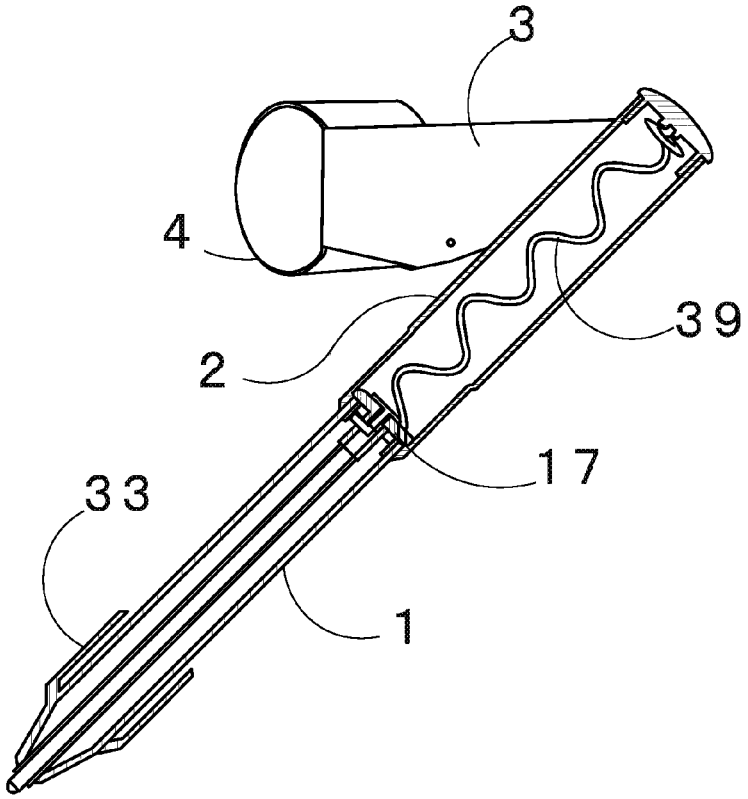
FIG. 21 is a partial cross-sectional side view showing the writing tool in the written condition according to Example 5.

The present example describes a writing tool for mounting on a finger, in which an axis body 1 and a cap 2 each are formed in a cylindrical shape, a helicate 39 is provided in the axis body 1, and the axis body 1 is rotated to thereby enable expansion and contraction of the writing tool exerted by an induction action of the helicate 39. FIG. 19 to FIG. 21 are the drawings related to the present example.

Although the helicate 39 is provided in a space between the cylindrical shell of the axis body 1 and the pen lead 6, the rear end of the helicate 39 is securely provided at the tail part of the cap 2, and the front side is inserted into the shell of the axis body 1 through the through hole 31 that is provided in the tail valve 17 of the pen lead 6. If the axis body 1 rotates by two turns to three turns, the axis body 1 can advance and retract from the front side to the rear side of the cap 2 due to the induction of the helicate 39. A large tip 33 of the axis body 1 forms a double wall which is slightly larger than the outer circumference of the cap 2 so as to cover a circumferential surface of the cylindrical body of the cap in the retained condition. In addition, a side groove 11 is provided in a respective one of the circumferential surface of the double wall and the front part of the linking member 3 (refer to FIG. 19 and FIG. 20).

The linking member 3 forms a plate-like body of which length is approximately the same as that of cap 2. On one face at a tip end of the plate-like body, a band body allowed to have adhesiveness is wound as the part for mounting on the finger 4. Also, the tail part of the cap 2 is brought into axial contact with a rear part of the plate-like body by the rear axis 8. In addition, a protrusion 26 formed by folding the plate-like body toward the cap 2 is provided at the tail part of the linking member 3 (refer to FIG. 19).

The writing tool of the present example is formed by the operation described above. When this writing tool is used, if the band body of the part for mounting on the finger 4 is wound around the index finger and then the thumb is lowered while abutting against the periphery of the large tip 33 of the axis body 1, the axis body 1 is lowered while rotating due to a gear meshing action between the side groove 11 that is provided in the surface of the large tip 33 and the side groove 11 that is provided in the linking member 3. When the axis body 1 rotates, the tail valve 17 advances due to guiding of the helicate 39, and the axis body 1 is thereby expanded from the inside of the cap 2. In addition, when the angle of the written condition is reached, the writing tool main body 5 is expanded to the standard direction of the written condition.

In a case where the length of the writing tool is insufficient, if the axis body 1 is twisted with the thumb and the index finger gripping the large tip 33, the writing tool advances and retracts while rotating in accordance with the twisted direction, so that the entire length of the writing tool main body 5 can be thereby freely adjusted according to the preference. Also, rotation of the cap 2 stops at a predetermined angle due to the engagingly locking action of the protrusion 26 that is provided in the linking member 3. Thus, even if the hand is released, the posture does not collapse. With regard to the degree of inclination in the written condition, the degree of engagement and the elasticity of the rear axis 8 is adjusted, whereby, even if the large tip 33 is released from the linking member 3, the writing tool is inclined so as to be under the index finger (refer to FIG. 20 and FIG. 21).

When the written condition is switched to the retained condition, if the axis body 1 is pushed up after the large tip 33 has been turned with the thumb and the index finger in the opposite direction to that at the time of switching or if the axis body is pushed up while being turned, the axis body 1 is pushed up while retracting into the cap 2. The axis body then comes into contact with the linking member 2 and rotation is thereafter continued due to the gear meshing action between the side grooves 11. In addition, if the axis body is parallel to the linking member 3, the axis body 1 is retracted into the cap 2, and the retained condition is set while in the shortened state. In the retained condition, the stability can be kept due to the gear meshing action between the side grooves 11 and the engagingly locking action of the rear axis 8 or the like. When the writing tool 5 is released from a finger, the band body of the finger mounting member 4 is released from a finger and then is wound around the linking member 3, and the writing tool is compactly formed. Even after the writing tool has been released from a finger, the large tip 33 is turned and the axis body 1 is thereby expanded outward from the inside of the cap 2, and the writing tool can be used in the same manner as that in the general writing tool as well.

In addition to the abovementioned structure, the writing tool of the present example can be applied to some of the variety of types such that: in place of rotating the axis body 1, the cap 2 is rotated, and in place of providing the helicate 39, a helical groove is provided in a respective one of the circumferential face of the shell of the axis body 1 and the inner circumferential wall of the cap 2 so as to respectively rotate the axis body 1 and the cap 2 in the opposite direction; further, without being fixed to the cap 2, the helicate 39 is further extended up to the rear side of the rear axis 8, and the linking member 3 is also extended up to the same length as that of the helicate 39; and gear grooves meshing with each other are provided, the helicate 39 is rotated, and the axis body 1 is advanced and retracted merely by the operation of vertically moving the cap 2 or the like (refer to FIG. 20).

Example 6

Figure 22:
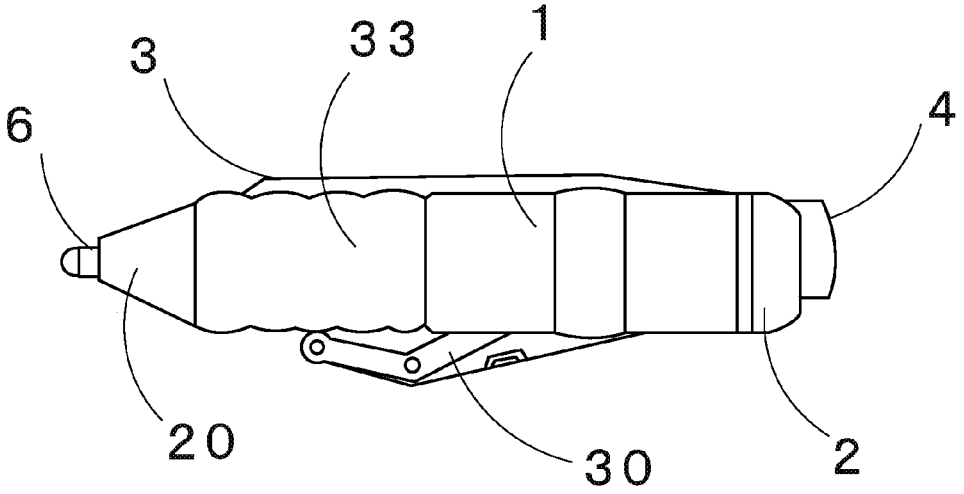
FIG. 22 is a side view showing the writing tool in the carried condition according to Example 6.
Figure 23:
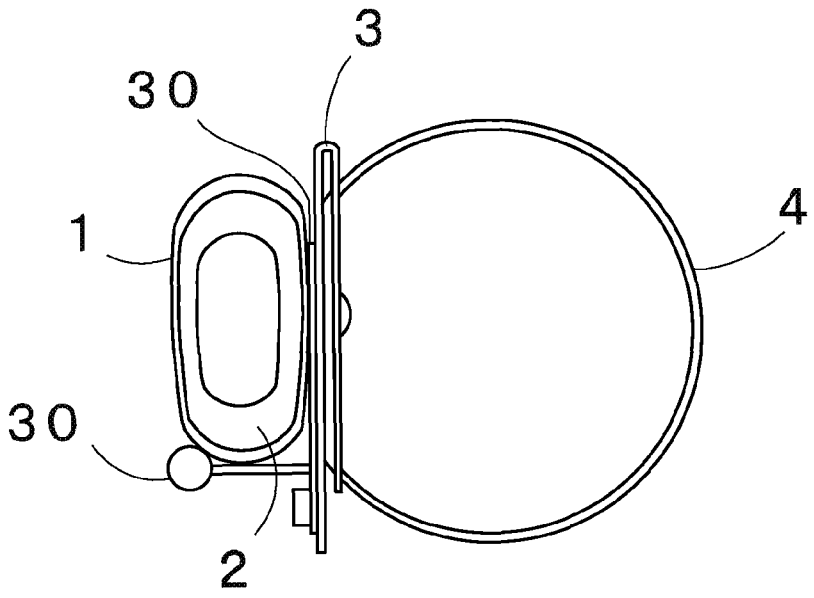
FIG. 23 is a rear view showing the writing tool in the retained condition according to Example 6.
Figure 24:
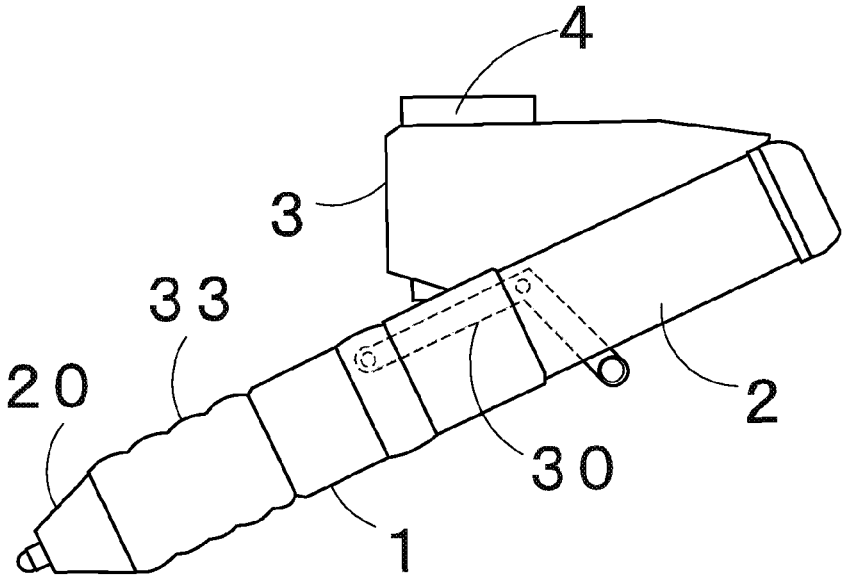
FIG. 24 is a side view showing the writing tool in the written condition according to Example 6.

The present example describes a writing tool for mounting on a finger, in which a stripped body that can be wound in a ring shape is brought into axial contact while being sandwiched between linking members 3 of double walls, a cap 2 is inserted from a tail end into a shell of an axis body 1, a linking member 3 and the axis body 1 are connected to each other by one pulling arm 30, and condition switching is carried out by operation of the arm. FIG. 22, FIG. 23, and FIG. 24 are drawings related to Example 6.

The linking member 3, like Example 1, forms a double wall obtained by folding the plate-like body. At the thumb side of the tail part of the linking member 3, the tail part of the cap 2 is brought into axial contact therewith by the rear axis 8. Also, the axis body 1 fixes the pen lead 6 to the base 20 in front of the cylindrical body that is formed in an oval cylindrical shape. Afterwards, the tail part of the axis body 1 inserts the cap 2 that is slightly thinner than the axis body 1 into a hollow between the pen lead 6 and the shell and then is provided so as to be forwardly and backwardly slidable. In addition, the rear end of one pulling arm 30 is brought into axial contact with the tail valve of the body 1, and the intermediate part comes into axial contact with a lower end in front of the thumb side wall of the linking member 3. Further, the front end is expanded up to the lower side of the large tip 33 and then is protruded up to a position which the thumb reaches (refer to FIG. 22 and FIG. 23).

The writing tool of the present example is formed by the operation described above. When this writing tool is used, if the part for mounting on the finger 4 while being sandwiched between the double walls of the linking member 3 is rotated so as to be perpendicular to the linking member 3 and then is wound around the index finger, the writing tool is kept in the retained condition while being housed in the shell of the cap 2. In the retained condition, at the front side of the writing tool, the tip of brush 13 is oriented forward around the second joint 15 of the index finger. In addition, at the rear part of the writing tool, the rear end of the cap 2 is positioned around the root joint 16 and then is set in a parallel state to the index finger. The rear part of the cap 2 and the linking member 3 are linked with each other, and the rear part of the axis body 1 is also brought into continuous contact with the linking member 3 via the pulling arm 30, so that the stability is retained due to the engagingly locking action of the two parts (refer to FIG. 22).

When the retained condition is switched to the written condition, if the thumb is lowered while abutting against the front end of the pulling arm 30, the axis body 1 is raised by the rear end of the pulling arm 30 and then lowers from the front side while expanding along the semicircular rotation trajectory of the pulling arm 30, Afterwards, if the axis body 1 reaches the angle of the written condition, the frame of the pulling arm 30 abuts against the protruding wall of the linking member 3, whereby the rotation stops. At this time, the cap 2 is brought into axial contact with the linking member 3, so that the cap rotates while retaining its position. Therefore, only the angle varies, the axis body 1 is expanded to the front side of the cap 2, and the standard dimension and angle of the written condition are obtained.

At this time, the front end of the pulling arm 30 is rotated to the rear side and then is placed at the thumb side on the bottom of the cap 2. The degree of inclination of the writing tool in the written condition is formed by adjusting the degree of inclination of two axial contact points that are provided at the above linking member 3, without a need to provide a specific mechanical engine in particular. In addition, when the written condition is switched to the retained condition, operation is carried out in the opposite direction to that at the time of switching the rear end of the pulling arm 30 to the written condition with the thumb, and the written condition is thereby switched to the retained condition (refer to FIG. 24).

In the present example as well, without providing the pulling arm 30, it is possible to carry out expansion or contraction and advancing or retracting by utilizing the slipping force exerted by the own weight of the axis body 1. In addition, a lead protective tube 25 is provided at the tip end of the cap 2 and then the tip of brush 13 in the retained condition can be concealed in the lead protective tube 25 as well. Further, the cap 2 is expanded while being put in the top layer, and the axis body 1 in the retained condition can be thereby completely built in the cap 2 as well.

Example 7

The present example describes a writing tool for mounting on a finger, in which a part for mounting on a finger 4 is built in a linking member 3, and a standard dimension of the writing tool in a written condition is approximately divided into three sections which are an axis body 1*a*, an axis body 1*b*, and a cap 2. In addition, the axis body 1*b* is interposed to be slidable in the axis body 1*a*, whereby in the written condition, the axis body 1*a*, the axis body 1*b*, and the cap 2 are expanded to form a length of the writing tool, and in the retained condition, in a state in which the axis body 1*b* is inserted into the axis body 1*a*, the cap 2 is housed, and a writing tool main body 5 is thereby further made compact. FIG. 25 to FIG. 28 are drawings related to Example 7.

The linking member 3 forms a double wall obtained by folding a plate-like body of which length is divided into the three sections as described above. A bottom face of the double wall is opened, and an inside wall of the cap 2 is internally sandwiched therebetween and then is brought into axial contact therewith by a rear axis 8, so that the cap 2 can rotate up to a predetermined angle of the written condition. In addition, upward of the double wall, a cylindrical cavity chamber 41 protruding in a direction of the index finger is provided. In the cavity chamber 41, a supporting axis is overhung in a longitudinal direction, and at an outer circumference of the supporting axis, an expanded spring is interposed. Further, at an outer circumference of the spring, a band body 43 is wound as means for mounting on a finger 4. Furthermore, in the index finger side of a front part of the cavity chamber 41, an aperture 34 is provided, and in the aperture 34, a tip end of the band body 43 is hooked. Still furthermore, under the index finger side wall of the double wall, a hook 44 for hooking the band body 43 is provided, and under the wall at the thumb side of the double wall, a protruding part 9 which is similar to that in Example 1 described above is provided (refer to FIG. 25 and FIG. 26).

The cap 2, like Example 1 described above, opens a top face, and wall faces are provided on three faces, that is, both sides and a bottom. Among these three faces, a portion of a front part of the inside wall at the index finger side is cut out so as to enable a tail wall 24 of the axis body 1*b* to rotate without difficulty. In addition, a rear part is sandwiched between both walls of the linking member 3 and then is brought into axial contact therewith by the rear axis 8. Other operations are similar to those of Example 1 (refer to FIG. 25).

The writing tool of the present example is formed by the operation described above. When this writing tool is used, first, if an end of the band body 43 is sandwiched and pulled, the band body 43 that is wound around the outer circumference of the spring in the cavity chamber 41 is extracted from the inside of the cavity chamber 41. Thus, the retained condition is set, if the band body is wound around a site between a second joint 15 and the root joint 16 and then is hooked by the hook 44.

When the retained condition is switched to the written condition, if the thumb is raised and then the front part of the cap 2 is lowered, the axis body 1 and the cap 2 that are established in the folded state are linearly expanded while being rotated, in accordance with the same principle as that in Example 1 described above. However, at this time, in Example 2, the length of the writing tool required for the written condition was divided into two sections which are the axis body 1 and the cap 2. Therefore, the writing tool is expanded to a required length merely by expanding the axis body 1 and the cap 2, whereas in the present example, when the axis body 1 is rotated, the axis body 1*a* is subjected to its own weight and a centrifugal force and then the axis body 1*a* is released from the axis body 1*b*, and three members which are the axis body 1*a*, the axis body 1*b*, and the cap 2 are thereby linearly expanded and then the length of the written condition is formed (refer to FIG. 26).

In addition, when the written condition is switched to the retained condition, basic means for pushing up the cap 2 with the thumb and then folding the axis body 1 and the cap 2 is similar to that in Example 1. However, in the present example, when the axis body 1 rotates up to a position at which the axis body becomes substantially perpendicular to the cap 2, a friction between the axis body 1 and the cap 2 occurs, and rotation of the axis body 1 is slowed down. Therefore, at this time, the axis body 1*a* is slipped down due to its own weight, the writing tool 1*b* is inserted into the axis body, and the axis body 1 is housed in the cap 2 in the shortened state. Hence, in the retained condition, the writing tool can be retained at a length at which the writing tool is completely kept between the second joint 15 and the root joint 16 of the index finger (refer to FIG. 28).

Figure 25:
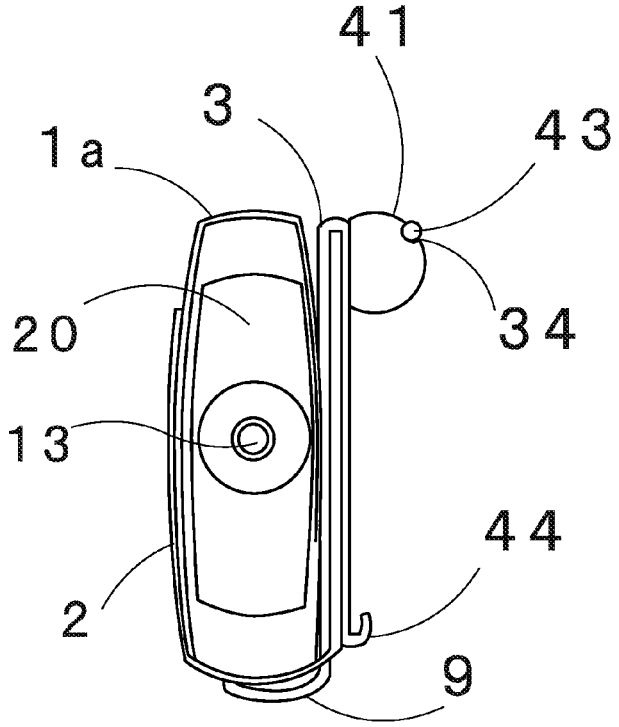
FIG. 25 is a rear view showing the writing tool in the carried condition according to Example 7.
Figure 26:
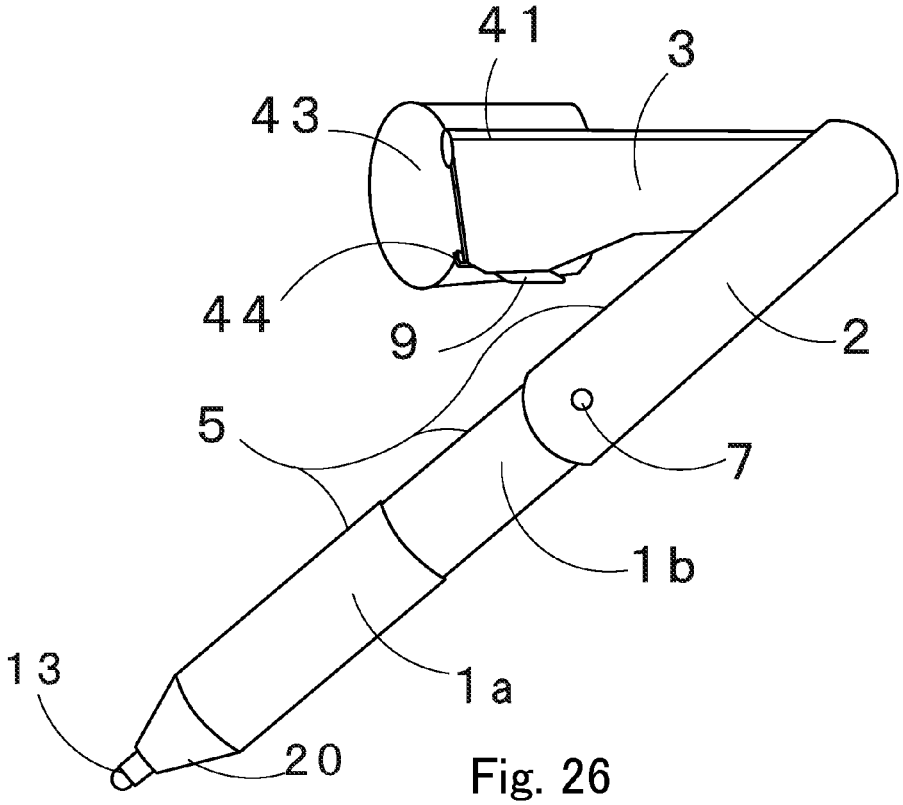
FIG. 26 is a side view showing the writing tool in the written condition according to Example 7.
Figure 27:
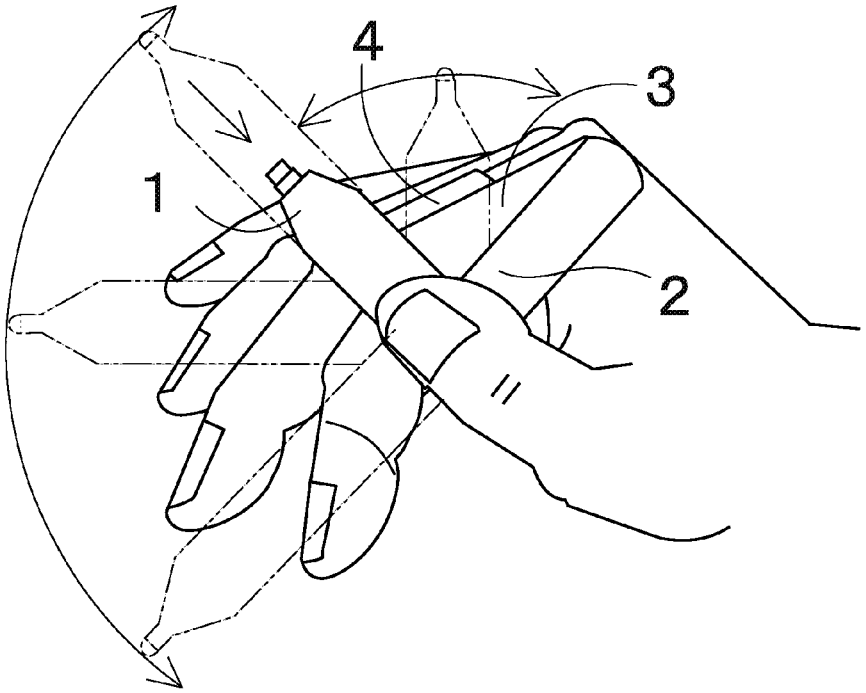
FIG. 27 is a diagram showing dynamics of the writing tool in the retained condition and the written condition according to Example 7.
Figure 28:
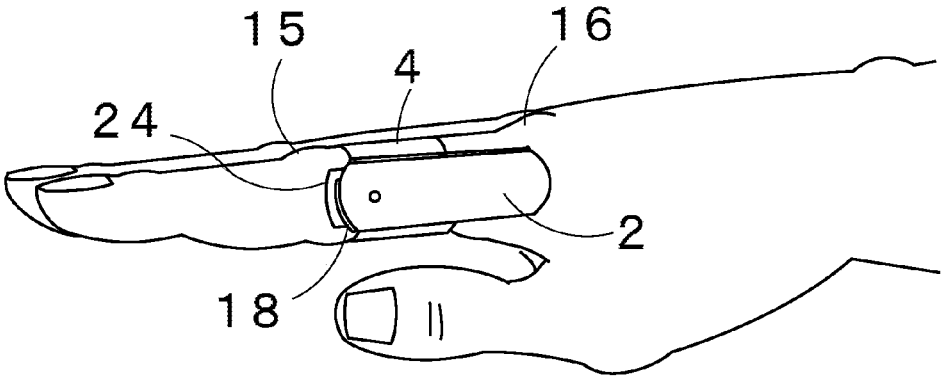
FIG. 28 is a diagram showing a condition in which fingers are straight in the retained condition according to Example 7.

When the writing tool is released from a finger, if the band body 43 in the retained condition is released from the hook 44, the band body 43 is wound into the cavity chamber 41 due to a resilient force of the spring, and a compactly housed carried condition is set (refer to FIG. 25).

Example 8

Figure 29:
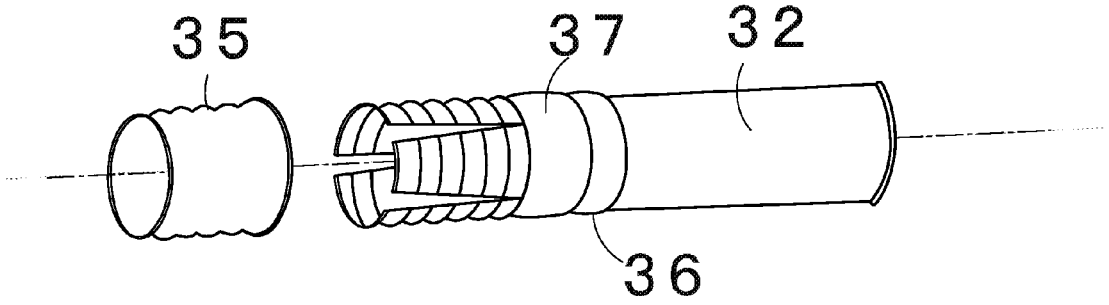
FIG. 29 is an exploded view showing a pen holder according to Example 8.
Figure 30:
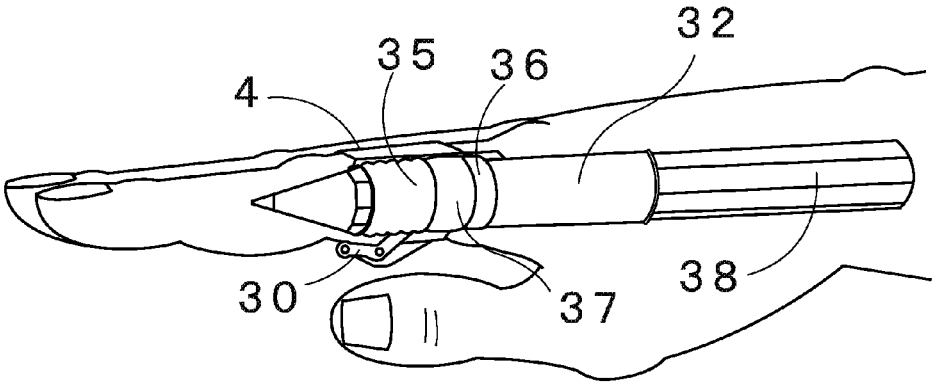
FIG. 30 is a diagram showing a condition in which fingers are straight in the retained condition according to Example 8.
Figure 31:
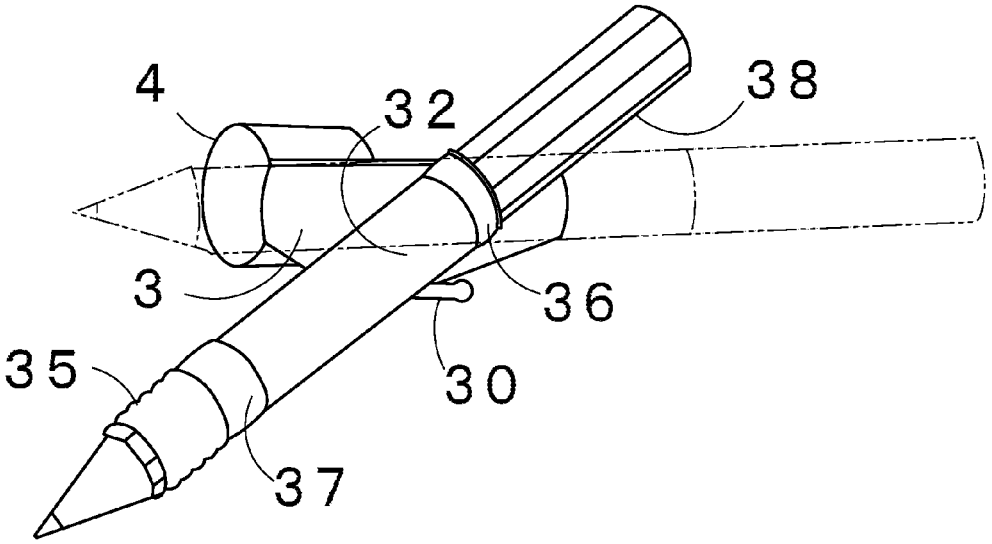
FIG. 31 is a diagram showing a positional alteration of the writing tool in the retained condition and the written condition according to Example 8.

The present example describes a writing tool finger holder which is used while a written condition and a retained condition are interchangeably switched while an existing writing tool such as a pencil of which thickness is constant is retained with fingers. FIG. 29, FIG. 30, and FIG. 31 are the drawings related to Example 8.

A linking member 3 forms a plate-like body of which length is the same as that of a cap 2 of a standard type of a writing tool for mounting on a finger, and the band-like part for mounting on a finger 4, that is made of an elastic material, can be wound around a front part of the linking member 3. In addition, in place of the cap 2 of the writing tool for mounting on the finger, a cylindrical pen holder 32 is provided, and a tail thereof is brought into axial contact with the linking member 3 via a ring member 36. Also, the pen holder 32 is provided so as to be freely forwardly and backwardly slidable through the ring member 36.

In addition, with respect to a pulling arm 30 which is similar to that in Example 6 described above, an intermediate part is bought into axial contact with a front part of a thumb side wall of the linking member 3 up to a predetermined angle of a written condition. Also, a rear part is brought into axial contact with a supporting ring 37 which is circularly provided at an outer circumference of a cylindrical body of the pen holder 32, and a front end is expanded up to a lower part of a screw tightening cylinder 35 and then is laterally abutted against a portion which the thumb easily reaches. In the pen holder 32, a screw base is provided on circumferential wall of a cylindrical tip end, and slits are provided at predetermined intervals to thereby enable the expansion and contraction of an aperture of the cylinder and then the screw tightening cylinder 35 is securely tightened therein (refer to FIG. 29 and FIG. 30).

The writing tool of the present example is formed by the operation described above. When this writing tool is used, first, the writing tool such as the existing pencil is inserted into the pen holder 32, adjustment is made to obtain an optimal length in a written condition, and the pen is fixed by turning the screw tightening cylinder 35. In addition, if the band-like part for mounting on the finger 4 is opened and then is wound around the index finger, a retained condition as a parallel state to the index finger is set in a state in which a tip of brush 13 is slightly more protrusive than the second joint 15 of the index finger (refer to FIG. 30).

When the retained condition is switched to the written condition, if the thumb is lowered while abutting against a front end of the pulling arm 30, a rear end of the pulling arm 30 raises the pen holder 32 via a supporting ring 37. Then, the writing tool is lowered while advancing, along a rotating trajectory of the pulling arm 30. If an angle of the written condition is reached, the rotation of the pulling arm 30 stops. At this time, the ring member 36 is brought into axial contact with the linking member 3 and thus the ring member locally rotates. Then, only the angle varies, the pen holder 32 is pulled to the rear end of the pulling arm 30 and then is expanded in front of the ring member 36, and the length and angle of the writing tool both become a standard for the written condition. The degree of inclination, the stability, and the reverse movability or the like are similar to those in Example 6 described above (refer to FIG. 31).

When the written condition is switched to the retained condition, a front end of the pulling arm 30 that is placed under the pen holder 32 is pushed forward while being lowered. The written condition is switched to the retained condition by the reverse movement to that at the time of switching to the written condition. In the retained condition, a length of the writing tool main body 5 varies depending on a length of the existing writing tool to be inserted, and a fixed portion can be adjusted so that a tip of brush 13 does not protrude more significantly than the second joint 15. In addition, in the present example, in place of providing the pulling arm 30, means for switching the expansion and contraction or advancing and retracting and the conditions of the writing tool can also be provided by utilizing the slipping force exerted by the own weight of the writing tool.

When the writing tool is released from a finger, the band-like part for mounting on a finger 4 is released, and the inserted pen such as a pencil is removed from the pen holder 32 by turning the screw tightening cylinder 35. Then, the band-like part for mounting on a finger 4 is wound around the linking member 3 or the linking member 3 and the pen holder 32 are wound together, and a compactly carried condition is thereby obtained. In the present example, a structure of the pen holder 32 has been developed so that the pen holder is available for use in an expanded pen such as a pencil while being retained with the fingers. It is possible to expect advantageous effects of learning how to correctly hold a pen, making the fingers comfortable and lessening the fatigue of the fingers, and improving the writing skills more remarkably than freehand. Therefore, this pen holder can also be used as a teaching tool or a rectifying tool.

Example 9

Figure 32:
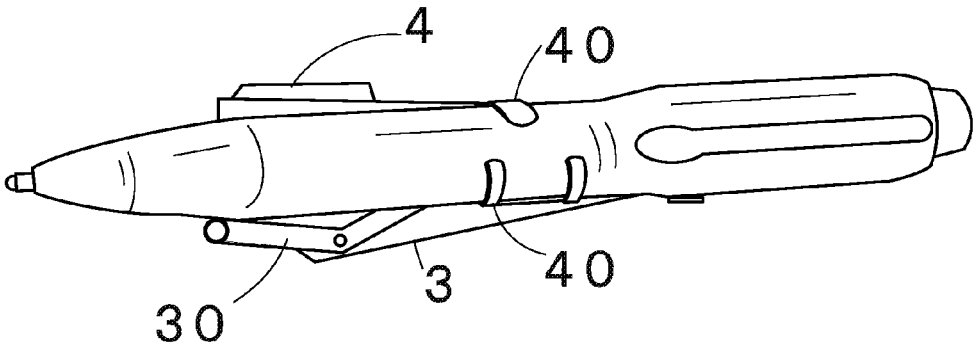
FIG. 32 is a side view showing the writing tool in the retained condition according to Example 9.
Figure 33:
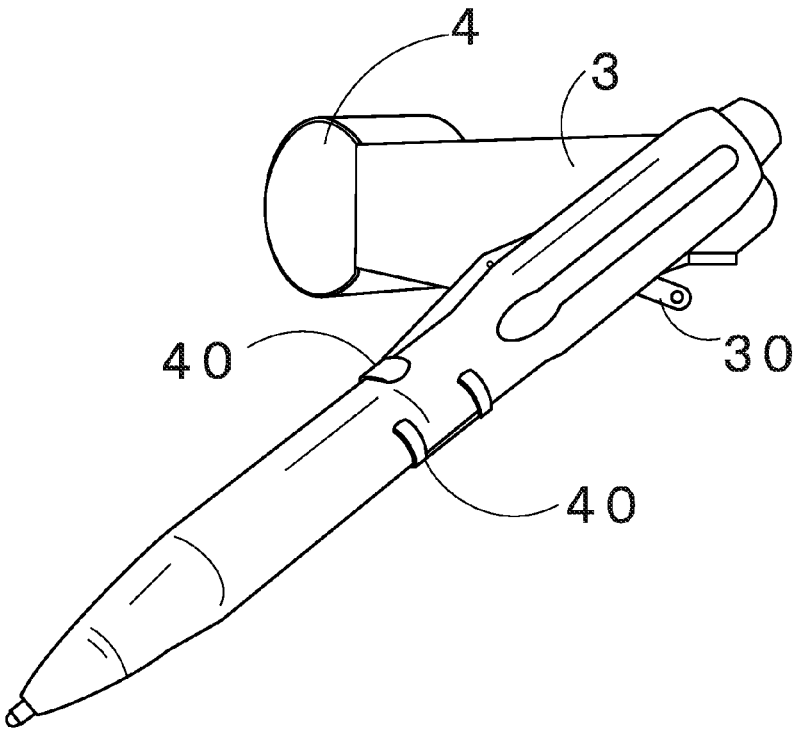
FIG. 33 is a side view of the writing tool in the written condition according to Example 9.
Figure 34:
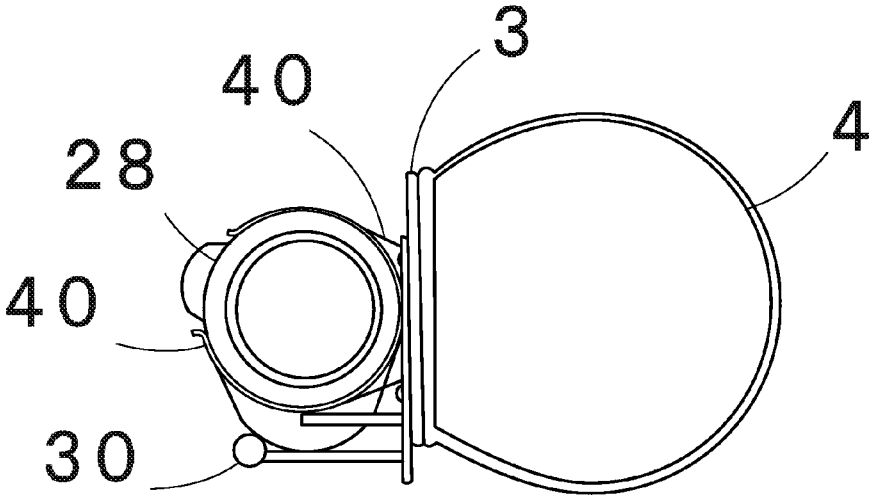
FIG. 34 is a rear view of the writing tool in the retained condition according to Example 9.

Although the present example, like Example 8 described above, describes a writing tool holder capable of retaining an existing writing tool with fingers, while the holder of Example 8 is exclusively used in a rod-like writing tool with its constant thickness such as a pencil, the holder of the present example is capable of holding a variety of writing tools having their different thicknesses and shapes. Thus, a part for mounting on a finger 4 is similar to that of Example 8, and in place of the pen holder 32 of Example 8, a sandwiching member 40 was provided. The condition switching operations or the principles of moving the writing tool or the like are similar to those of Example 8 (refer to FIG. 32, FIG. 33, and FIG. 34).

DESCRIPTION OF REFERENCE NUMERALS

1 axis body
2 cap
3 linking member
4 part for mounting on a finger
5 writing tool main body
6 pen lead
7 front axis
8 rear axis
9 protruding part
10 stop teeth
11 side groove
12 mounting tool axis
13 tip of brush
14 hole
15 second joint
16 root joint
17 tail valve
18 axis protrusion part
19 linking supporting member
20 base
21 spiral tail valve
22 knob
23 sandwiching member
24 tail wall
25 lead protective tube
26 protrusion
27 slip ring
28 ball pen
29 touch pen
30 pulling arm
31 through hole
32 pen holder
33 large tip
34 aperture
35 screw tightening cylinder
36 ring member
37 supporting ring
38 pencil
39 helicate
40 sandwiching member
41 cavity chamber
42 first joint
43 band body
44 hook

The invention claimed is:

1. A writing tool for mounting on a finger, comprising:

a writing tool main body formed by linking at least an axis body and a cap;

a linking member linked with the writing tool main body; and a part for mounting on a finger, provided in the linking member, wherein the writing tool main body is mounted at a thumb side of an index finger, the writing tool is used by alternately exchanging a condition thereof in a retained condition and a written condition, in the written condition, the writing tool is linearly extended, is rotated by a front lower part of the index finger to support, and is made rotatable in a direction of the retained condition, and an angle of the writing tool is thereby made freely adjustable, in the retained condition, the writing tool is divided into at least the axis body and the cap and then a necessary shortest size of the writing tool is shortened by means of folding or storing, and the writing tool is thereby shortened by retracting the writing tool up to at least a site close to a second joint of an index finger and retaining the writing tool in parallel to the index finger, and in a carried condition, the writing tool is removed from a finger, the part for mounting on the finger is sandwiched therebetween and then is built in, is wound around, and is folded with or is eliminated from, the linking member, and the writing tool is thereby made deformable so that a volume of the writing tool is smaller than in the retained condition.

2. The writing tool for mounting on the finger, according to claim 1, wherein the axis body is brought into axis contact with the cap to make the writing tool for mounting on the finger foldable.

3. The writing tool for mounting on the finger, according to claim 1, wherein one of the axis body and the cap is stored in another one or overlapped with such another one to make the writing tool contractible in the retained condition.

4. The writing tool for mounting on the finger, according to claim 1, wherein the linking member has a double-wall structure.

5. The writing tool for mounting on the finger, according to claim 1, wherein a lead protective tube is protruded in front of a base and a pen lead is shortened into the base to enable a tip of brush to be concealed in the retained condition.

6. The writing tool for mounting on the finger, according to claim 1, wherein spiral convex and concave parts are provided on a circumference face or an inner circumference wall of at least one of the axis body, the cap, and a helicate, and upon alternately exchanging the written condition and the retained condition, at least one of the axis body, the cap, and the helicate including the spiral convex and concave parts is rotated, and the axis body is thereby guided by the spiral convex and concave parts and then advances and retracts, and the writing tool thereby expands and contracts.

7. The writing tool for mounting on the finger, according to claim 1, wherein at least one of a plurality of pen leads, light and a watch is annexed to the writing tool main body.

8. The writing tool for mounting on the finger, according to claim 1, wherein a pulling arm is provided in the linking member and the pulling arm is linked with the axis body.

9. The writing tool for mounting on the finger, according to claim 1, wherein, in alternately exchanging the written condition and the retained condition, operations of expanding and contracting, advancing and retracting, or rotating the writing tool are carried out by a thumb.

10. A writing tool finger holder, comprising:

a pen holder or a sandwiching member having a function of holding a writing tool;

a linking member including a part for mounting on a finger and linked with the pen holder or the sandwiching member by a pulling arm, wherein an existing writing tool is inserted into the pen holder or the sandwiching member the writing tool is mounted at a thumb side of an index finger, and the writing tool is used by alternately exchanging a condition thereof in a retained condition and a written condition, in the written condition, the writing tool is extended and rotated by a front lower part of the index finger and then the writing tool is made rotatable in a direction of the retained condition, and an angle of the writing tool is thereby made freely adjustable, in the retained condition, the writing tool is shortened by retracting the writing tool up to at least a site close to a second joint of an index finger and then retaining the writing tool in parallel to the index finger, and in a carried condition, the writing tool is removed from a finger and then the part for mounting on the finger is sandwiched by being built in, wound on, folded with or eliminated from, the linking member, and the writing tool is thereby made deformable so that a volume of the writing tool is smaller than in the retained condition.

* * * * *